US007458577B2

(12) United States Patent
Terada

(10) Patent No.: US 7,458,577 B2
(45) Date of Patent: Dec. 2, 2008

(54) IMAGE RECORDING APPARATUS

(75) Inventor: Kohei Terada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 61 days.

(21) Appl. No.: 11/690,606

(22) Filed: Mar. 23, 2007

(65) Prior Publication Data

US 2007/0228642 A1 Oct. 4, 2007

(30) Foreign Application Priority Data

Mar. 28, 2006 (JP) ..... 2006-088532

(51) Int. Cl.
*B65H 5/02* (2006.01)

(52) U.S. Cl. ..... 271/273; 271/272; 271/274

(58) Field of Classification Search ..... 271/264, 271/272, 273, 274, 125, 124, 275, 277
See application file for complete search history.

(56) References Cited

U.S. PATENT DOCUMENTS 3,756,589 A * 9/1973 Carbine ..... 271/274
4,256,299 A * 3/1981 Hogenson ..... 271/262
5,210,616 A * 5/1993 Kawasaki et al. ..... 358/296
5,465,955 A * 11/1995 Krupica et al. ..... 271/265.02
5,469,204 A * 11/1995 Kim ..... 347/218
2007/0145679 A1* 6/2007 Terada ..... 271/272

FOREIGN PATENT DOCUMENTS

JP 2004-106345 A 4/2004
JP 2004-122609 A 4/2004
JP 2004-168451 A 6/2004

* cited by examiner

*Primary Examiner*—Patrick Mackey
*Assistant Examiner*—Patrick D Cicchino
(74) *Attorney, Agent, or Firm*—Baker Botts L.L.P.

(57) ABSTRACT

In an image recording apparatus, a feed roller pair including a drive roller and a pinch roller is disposed on an upstream side of a sheet feed direction from an image recording unit. The pinch roller is rotatably supported in a pinch roller holder so as to press in contact with drive roller with a specified pressure. A holder support member is integrally formed with an inside frame constituting a housing of the apparatus. Rolling bearings are interposed between the pinch roller holder and the holder support member. The pinch roller holder is supported in the holder support member so as to roll in a direction where a recording sheet is fed.

15 Claims, 18 Drawing Sheets

IMAGE RECORDING APPARATUS

CROSS REFERENCE TO RELATED APPLICATION

This application claims priority to and the benefit of and priority to Japanese Patent Application No. 2006-088532, filed Mar. 28, 2006, the entire subject matter and disclosure of which is incorporated herein by reference.

BACKGROUND OF THE INVENTION

1. Field of the Invention

The invention relates to an image recording apparatus configured to record images on sheets of recording media, more specifically to an image recording apparatus configured to feed the recording media by a feeding device comprising a drive roller and a driven roller pressing in contact with drive roller.

2. Description of the Related Art

As shown in FIGS. 18A-18C, a known inkjet-type image recording apparatus is provided with a feed roller pair 103 that feeds a recording sheet S (an example of a recording medium) supplied from a sheet supply tray, not shown, to a platen 102. In this image recording apparatus, recording sheet S is fed by feed roller pair 103 intermittently by a predetermined length, while a carriage 101 having a recording head 100 is slid in a direction perpendicular to a direction where recording sheet S is fed in order to eject ink droplets from nozzles of recording head 100 to recording sheet S. Thus, an image is recorded onto the recording sheet S in a predetermined area.

The intermittent feeding is performed by feed roller pair 103 disposed on an upstream side of platen 102 in the feed direction (hereinafter referred to as the "upstream side") and an ejection roller pair 104 disposed on a downstream side of platen 102 in the feed direction (hereinafter referred to as the "downstream side"), which have their rotation controlled by a control part, not shown.

Feed roller pair 103 includes a drive roller 105 and a driven roller 106. Drive roller 105 is configured to receive a rotational force transmitted from a motor and be driven. Driven roller 106 is urged by a coil spring 107 to press in contact with drive roller 105. As shown in FIG. 18A, when a leading end of recording sheet S supplied from the sheet supply cassette arrives at feed roller pair 103, it is pinched by drive roller 105 and driven roller 106, and feeding of recording sheet S is started by feed roller pair 103. As the feeding of recording sheet S proceeds, the leading end of recording sheet S is pinched by ejection roller pair 104, and recording sheet S is fed by both feed roller pair 103 and ejection roller pair 104 as shown in FIG. 18B. When the feeding of sheet S further proceeds, a trailing end of recording sheet S is separated from feed roller pair 103 as shown in FIG. 18C, and recording sheet S is fed by ejection roller pair 104 only. Ejection roller 104 also includes drive roller 108 and driven roller 109 as with feed roller pair 103. As ejection roller pair 104 is configured to pinch recording sheet S on which an image has been recorded, a low pressing force of ejection roller pair 104 is set to prevent images from deteriorating.

In the image recording apparatus constructed in this manner, when the trailing end of recording sheet S is separated from feed roller pair 103, a part of the pressing force that feed roller pair 103 applies to recording sheet S in a vertical direction will be translated in the feed direction. At this time, a force that is greater than a feeding force generated by the rotation of drive roller 105 acts on the trailing end of recording sheet S, and recording sheet S is slid on ejection roller pair 104 having the low pressing force and is fed with excessive force. As a result, streaks will be generated on recording sheet S, and the image quality will be deteriorated. This problem is most prevalent with a recording sheet such as glossy paper that is relatively thick and has high stiffness.

To solve the above problem, a known image recording apparatus includes a drive roller and a driven roller that is supported slidably and rotatably in the sheet feed direction. When the trailing end of a recording sheet comes off between drive roller and the driven roller, the driven roller recedes toward an upstream side upon a receipt of reaction force from recording sheet. More specifically, in this disclosed image forming apparatus, a rotary shaft of the driven roller slides in long holes, extending in the sheet feed direction, formed on a holder that supports the driven roller.

Nevertheless, in the known image forming apparatus, the reaction force is applied to the driven roller when recording sheet comes off, and the driven roller slides rearward. Thus, when the driven roller slides, a sliding frictional force is generated which is smaller than the reaction force, toward the downstream side with respect to the sheet feed direction. As the sliding frictional force acts in a direction to push recording sheet, recording sheet may be fed more than necessary. This phenomenon is hereinafter referred to as "excessive feeding." The excessive feeding may lead to a reduction of image quality that cannot be overlooked in high-resolution image forming apparatuses.

SUMMARY OF THE INVENTION

An embodiment of the invention provides an image recording apparatus that improves image quality by absorbing a force to push the trailing end of a recording sheet in the sheet feed direction when recording sheet comes off between a drive roller and a driven roller to prevent excessive feeding.

According to an embodiment of the invention, an image recording apparatus comprises a support plate configured to support a recording medium to be fed in a feed direction; an image recording unit disposed facing the support plate, the image recording unit configured to record an image on the recording medium fed onto the support plate; a feeding unit comprising a drive roller and a driven roller urged towards the drive roller, the feeding unit configured to feed the recording medium to the support plate; a first support member comprising an urging member, the urging member configured to apply a force urging the driven roller toward the drive roller, the first support member configured to support the driven roller rotatably; at least one guide member disposed on the first support member, the guide member protruding toward the support plate; and a second support member configured to support the first support member, the second support member comprising a roller bearing. The first support member is configured to be rolled to a first position via the roller bearing when the feeding unit feeds the recording medium, and the first support member is configured to be rolled to a second position via the roller bearing when the feeding unit does not feed the recording sheet, the second position being disposed at a position upstream in the feed direction relative to the first position.

In this case, a rolling friction is produced when the first support member is rolled. However, the rolling friction is relatively small compared with a sliding friction. Almost all force that acts in the feed direction when the trailing end of the recording medium comes off from the feeding unit acts as a force to roll the first support member from the first position to the second position. With this structure, compared with a known structure using sliding friction, an amount sliding friction to feed recording sheet in the sheet feed direction can be set closer to zero. As a result, the quality of an image to be recorded on recording sheet may be prevented from deteriorating.

In the image recording apparatus, the first support member comprises a guide member protruding toward the support plate. Thus, a space formed between the support plate and the first support member is closed by the guide member. Thus, a recording medium attempting to enter the space is blocked by the guide member to prevent jamming and damage to the recording medium. As the leading end of the recording medium is directed toward the platen by the guide member, the recording medium can be guided smoothly and fed to the support plate.

Further objects, features, and advantages of the present invention will be understood from the following detailed description of preferred embodiments of the present invention with reference to the accompanying drawings.

BRIEF DESCRIPTION OF THE DRAWINGS

Embodiments of the invention now are described with reference to the accompanying drawings, which are given by way of example only, and are not intended to limit the present invention.

DETAILED DESCRIPTION OF PREFERRED EMBODIMENTS

Preferred embodiments of the present invention, and their features and advantages, may be understood by referring to FIGS. 1-17, like numerals being used for corresponding parts in the various drawings.

Figure 1:
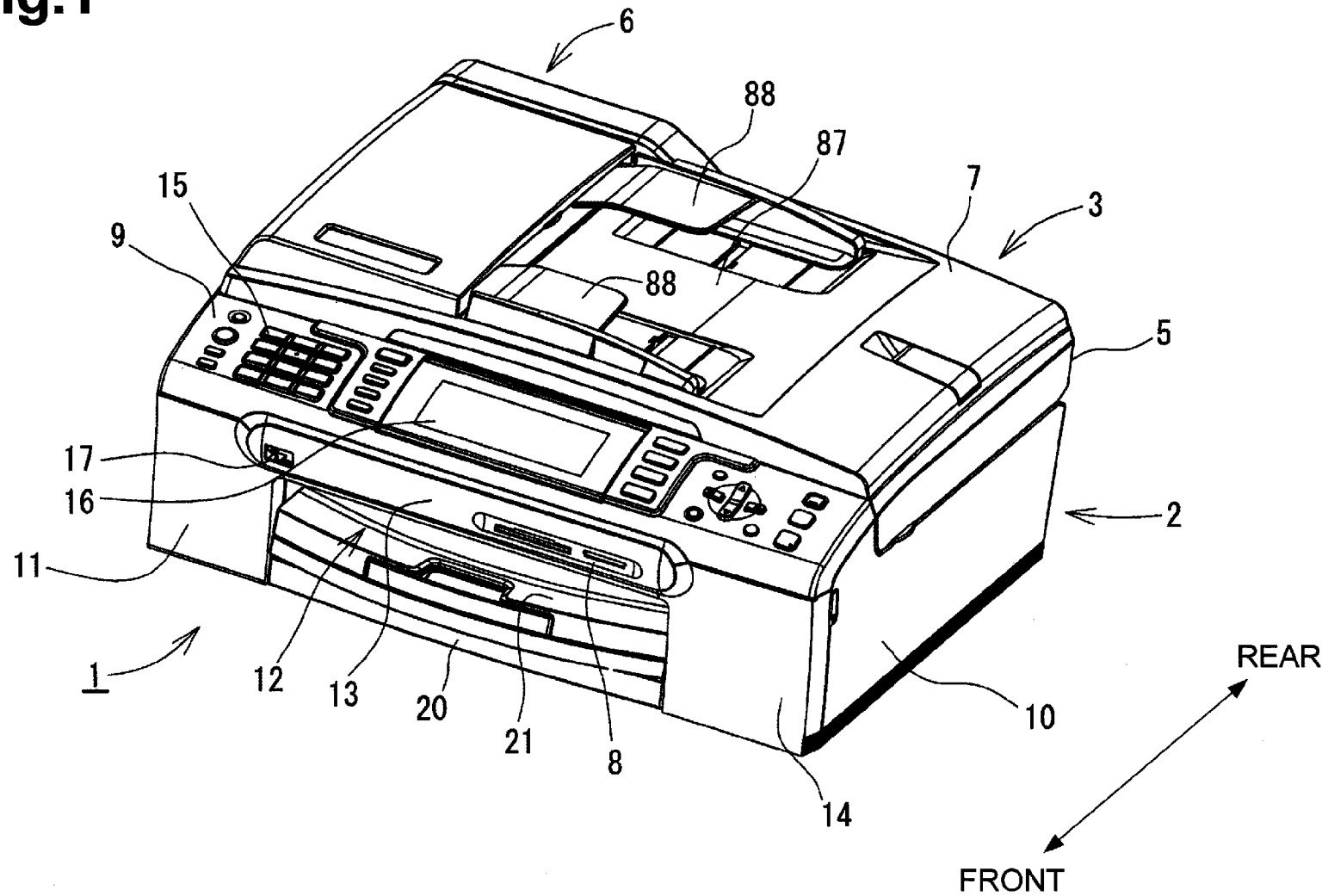
FIG. 1 is a perspective view of a multi-function apparatus according to an embodiment of the invention.
Figure 2:
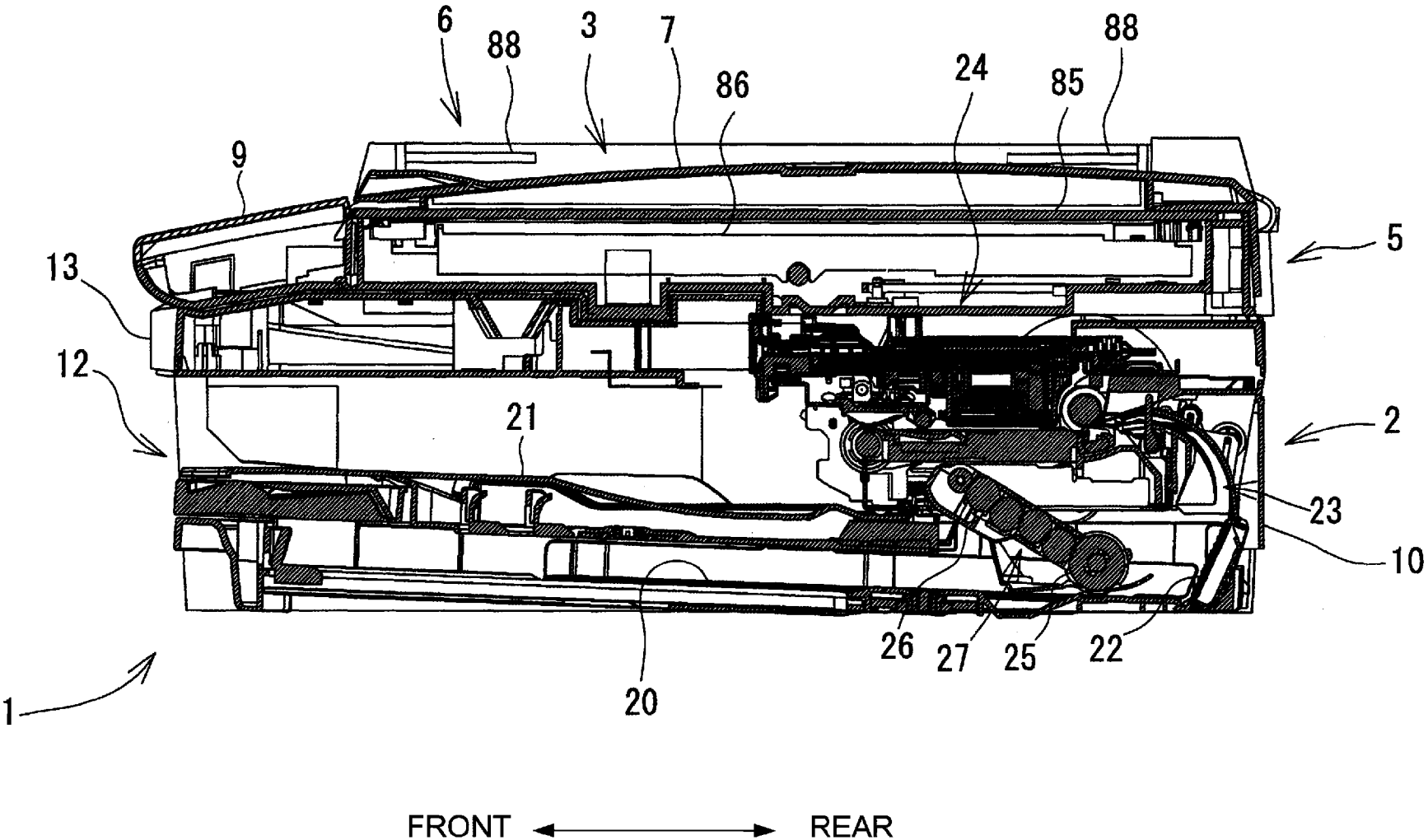
FIG. 2 is a cross-sectional view showing a structure of the multi-function apparatus.

As shown in FIGS. 1 and 2, a multi-function apparatus 1 integrally includes an inkjet recording type printer portion 2 disposed in a lower portion, and a scanner portion 3 disposed on printer portion 2. Multi-function apparatus 1 has a printer function, a scanner function, a copy function, and a facsimile function. Multi-function apparatus 1 functions as an image recording apparatus according to the invention. Multi-function apparatus 1 is just an example of the image recording apparatus of the invention, and thus does not necessarily includes the above all functions to realize the invention. That is, the printer function, the scanner function, the copy function, and the facsimile function are optional. The invention may be realized as at least a printer having the printer function.

For the printer function, the multi-function apparatus 1 may be connected to a computer, not shown, so that the printer portion 2 records images and text on recording sheets based on image data and text data transmitted from the computer. Printer portion 2 also records images on recording sheets based on image data input from an external device, such as a digital camera or a universal serial bus (USB) memory, for example, which is connected to multi-function apparatus 1. Printer portion 2 also records images and text on recording sheets based on data stored in a storage medium such as a memory card installed in the multi-function apparatus 1.

For the scanner function, image data acquired from scanning documents in scanner portion 3 may be transmitted to the computer connected with multi-function apparatus 1 by a wired or wireless connection. The scanned image data may be transmitted and stored in a memory device. For the copy function, the image data scanned by the scanner portion 3 may be recorded on recording sheets in printer portion 2. For the facsimile function, the image data scanned by scanner portion 3 is faxed via telephone line. Received facsimile data may be recorded on a recording sheet by printer portion 2.

As shown in FIG. 1, multifunction apparatus 1 may be of a substantially rectangle solid shape with a broad, low profile in which a width and a depth are greater than a height. The lower portion of multifunction apparatus 1 is printer portion 2. Printer portion 2 comprises a housing 10 constituting a frame of printer portion 2. An opening 12 may be provided on a front panel 11 constituting a front surface of the housing 10. Inside opening 12, input tray 20 and output tray 21 may be disposed vertically in tiers. Input tray 20 is configured to receive and store a stack of recording sheets, such as paper or plastic sheets, in a substantially horizontal orientation. Output tray 21 is configured to receive and store recording sheets on which image has been recorded. Connector panel 13 may be disposed above opening 12. In a right end portion of front panel 11, an opening, not shown, is provided and covered with door 14. Door 14 is pivotable about a shaft disposed on a lower end of the door 14 and openable frontward. Inside door 14, a refill unit is included. Ink cartridges may be detachably installed in the refill unit. In FIG. 1, the refill unit and the ink cartridges are not shown because they are installed within housing 10.

In an upper portion of the front of multifunction apparatus 1, an operation panel 9 may be provided for operation of printer portion 2 and scanner portion 3. Operation panel 9 includes operation buttons 15 and a liquid crystal display (LCD) 16. Multifunction apparatus 1 may be actuated based on an operation instruction (signal) from operation panel 9. When multifunction apparatus 1 is connected to an external computer, multifunction apparatus 1 may be actuated based on an instruction (signal) sent from the computer via a printer driver or a scanner driver.

Various connectors may be provided in connector panel 13 disposed on the front surface of multi-function apparatus 1 as shown in FIG. 1. Connector panel 13 may be shaped in a thin and long band along opening 12 extending in a width direction of multi-function apparatus 1 (in a direction vertical to the sheet of FIG. 2).

In a right end portion of connector panel 13, a slot portion 8 may be provided. Slot portion 8 may be capable of receiving a memory card of any kind therein and may be configured to electrically connect a control part of the multifunction apparatus 1 and the memory card. The memory card may be constituted as a card-type storage device in which a flash memory is embedded as a storage medium. Slot portion 8 may be provided with different card slots, which are arranged horizontally, to enable a memory cards of different types to be installed. The control part is structured as a known computer comprising, for example, a central processing unit (CPU), a read only memory (ROM), a random access memory (RAM), an electrically erasable and a programmable ROM (EEPROM).

In multifunction apparatus 1, when a memory card is inserted into slot portion 8, the control part of the multifunction apparatus 1 gains access to the memory card to read image data stored in the memory card. When the image data is read out, information regarding the image data, e.g., data names and preview images, may be displayed on LCD 16 of operation panel 9. When the user selects image data based on the information displayed on LCD 16, the selected image data is transferred to printer portion 2, and recorded on a recording sheet. The user may select image data using operation panel 9.

A universal serial bus (USB) connector 17 may be disposed at a left end of connector panel 13. The USB connector 17 may be configured to connect multifunction apparatus 1 with a USB memory having a USB terminal or a USB cable. Multifunction apparatus 1 may be communicably connected with an external device such as a digital camera and a USB memory via USB connector 17. Multifunction apparatus 1 may be configured to record image data from the external device onto a recording medium and transfer image data from the external device to a storage medium such as a memory card inserted into slot portion 8. The number of USB connectors 17 provided on connector panel 13 may vary as necessary, and not be merely limited to one.

The upper portion of multifunction apparatus 1 may be a scanner portion 3. As shown in FIGS. 1 and 2, scanner portion 3 comprises a document reading base 5 functioning as a flat bed scanner. A document cover 7 may be pivotally provided at the document reading base 5 via a hinge located at the rear of the apparatus. As shown in FIG. 2, a platen glass 85 may be disposed on an upper surface of document reading base 5. A document whose image is to be read may be placed on platen glass 85. An image sensor 86 such as contact image sensor (CIS), may be disposed under platen glass 85 or inside document reading base 5. Image sensor 86 may be placed such that a depth direction of multifunction apparatus 1 (left-right direction of FIG. 2) is regarded as the main scanning direction. Image sensor 86 may be configured to move reciprocally in a width direction of the multifunction apparatus 1 (in a direction perpendicular to the sheet of FIG. 2).

Document cover 7 may be provided with an auto document feeder (ADF) 6. ADF 6 is configured to feed documents successively from a document tray 87 via a document feed path (not shown) to output tray 88. During a feeding process by ADF 6, each document may be fed so as to pass a reading position on platen glass 85, and an image of the document is read by image sensor 86 disposed below the reading position. In this embodiment of the invention, scanner portion 3 and ADF 6 are optional, and, thus, not directly related to the invention. Consequently, detailed descriptions of scanner portion 3 and ADF 6 are omitted here.

Figure 3:
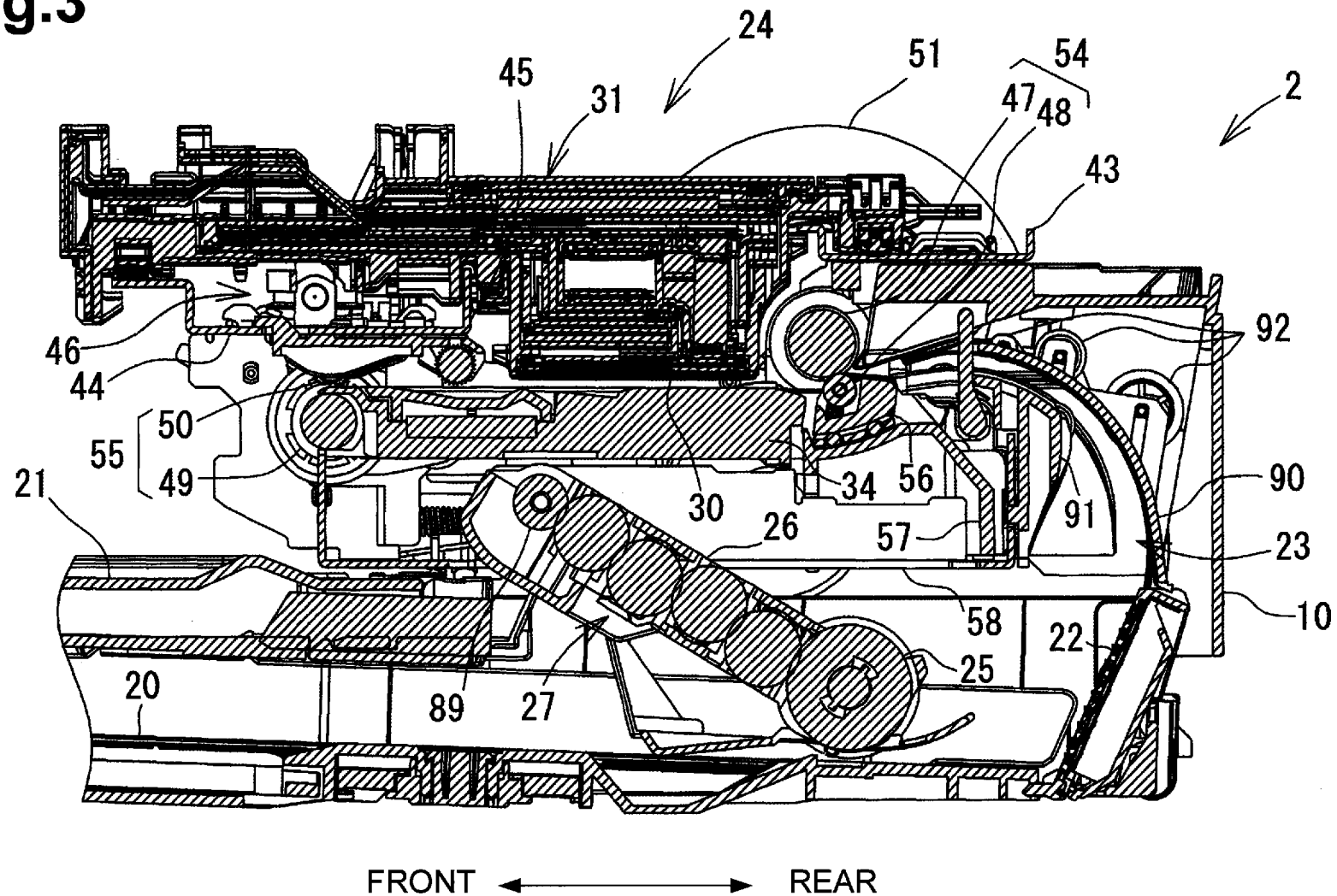
FIG. 3 is an enlarged cross-sectional view showing essential components of a printer portion.
Figure 4:
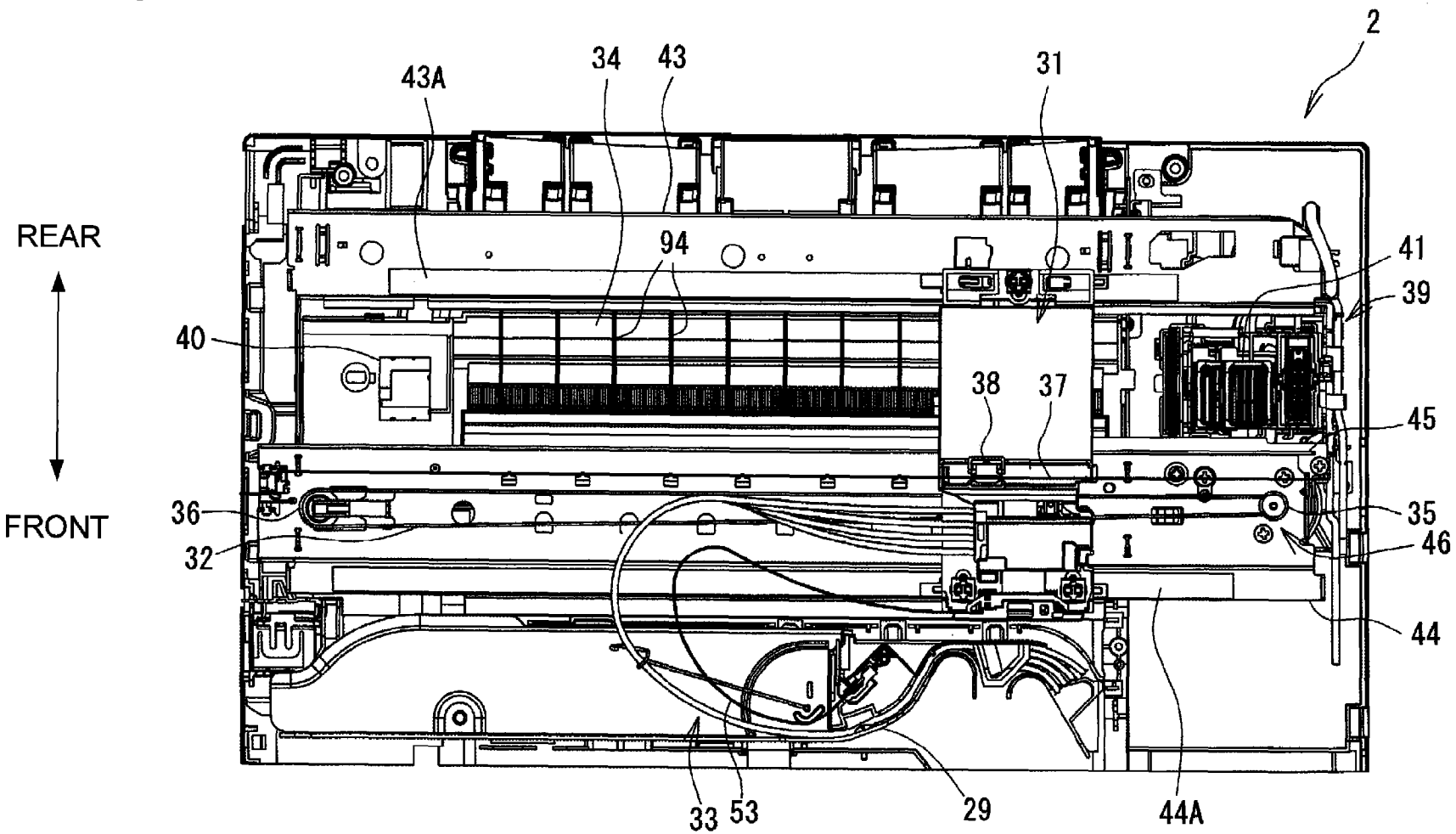
FIG. 4 is a plan view showing the essential components of the printer portion.
Figure 5:
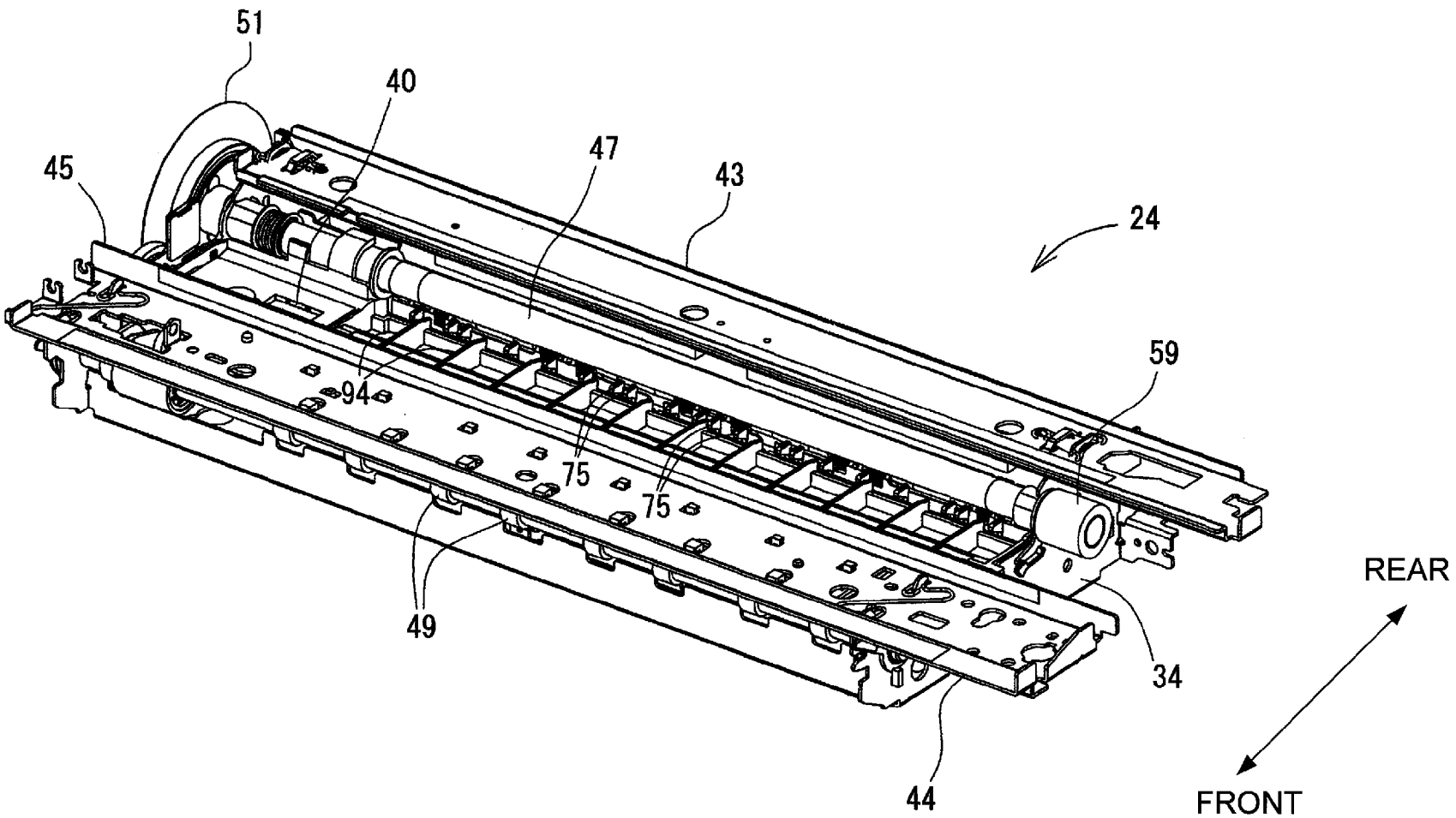
FIG. 5 is a perspective view of an image recording unit.
Figure 6:
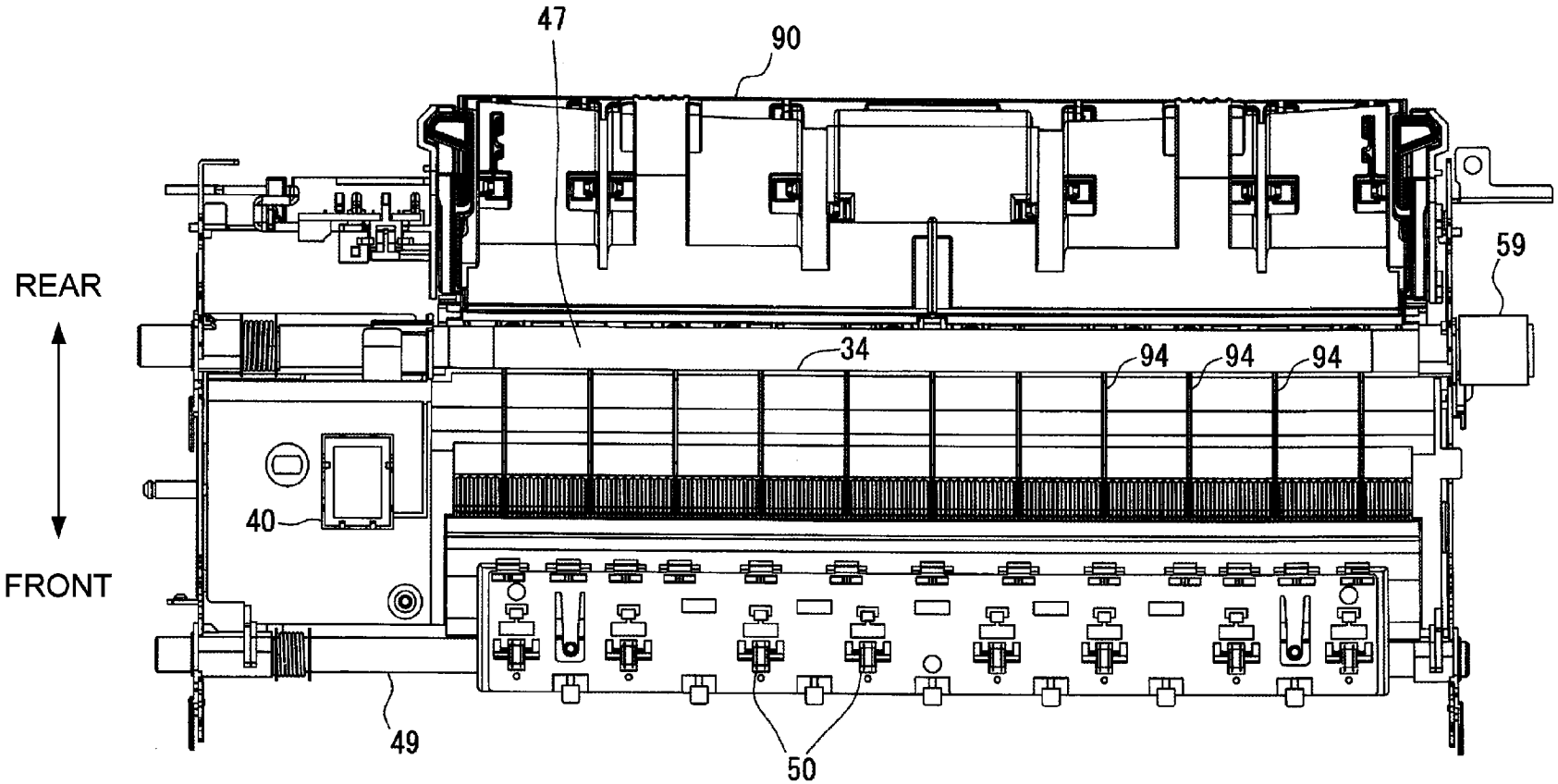
FIG. 6 is a plan view showing surroundings of the image recording unit.

With reference to FIGS. 1-7, the structure of printer portion 2 is described. In FIG. 5, recording head 30 and belt drive mechanism 46 are omitted. In FIG. 6, guide rails 43, 44 and a purge mechanism are omitted.

As shown in FIG. 2, opening 12 may be formed in a central portion of front panel 11 with respect to its width and a bottom end defining opening 12 reaches a bottom surface of multifunction apparatus 1. Input tray 20 is configured to receive and store recording sheets of A4 size or smaller, such as B5 size and postcard size. Input tray 20 comprises a slide tray (not shown). By drawing out the slide tray as necessary, a tray surface of input tray 20 extends to store legal-sized recording sheets.

As shown in FIG. 2, input tray 20 may be disposed on a bottom portion of multifunction apparatus 1. When input tray 20 is inserted inside the apparatus, the bottom surface of input tray 20 functions as the bottom surface of multifunction apparatus 1. When input tray 20 is placed in multifunction apparatus 1, recording sheet stored in input tray 20 may be set so that their longitudinal direction is a depth direction of multifunction apparatus 1. Output tray 21 may be supported by input tray 20 and disposed above input tray 20. In this embodiment, for example, output tray 21 and input tray 20 are constructed integrally.

When input tray 20 is inserted into opening 12 and placed inside the multifunction apparatus 1, a recording sheet is supplied to the rightward direction of FIG. 3 by a pick-up roller 25, and fed to the image recording unit 24 along a sheet feed path 23, which may be formed in a horizontally U-shape in a cross-sectional view.

As shown in FIG. 3, input tray may be provided with a separation plate 22, which may be disposed on a front end of input tray 20 with respect to a direction where input tray 20 is inserted, such that separation plate 22 inclines toward the rear side of the apparatus 1. Separation plate 22 may be configured to separate a recording sheet from a stack of recording sheets supplied from input tray 20 and to guide the recording sheet to an upper portion. In the upper portion of input tray 20, sheet feed path 23 may be formed. Feed path 23 curves upward from separation plate 22, turning to the front side, extending from the rear side to the front side of multifunction apparatus 1, passing through an image recording unit 24, and communicating with output tray 21. Recording sheets stored in input tray 20 may be inverted upward in sheet feed path 23 in such a manner to make a U-turn, guided to image recording unit 24, in which an image is recorded onto the recording sheet, and then ejected to output tray 21.

As shown in FIG. 3, pick-up roller 25 may be disposed above input tray 20. Pick-up roller 25 may be configured to contact an uppermost recording sheet stored in input tray 20 and feed recording sheet to separation plate 22. Pick-up roller 25 may be supported at an end of arm 26. Pick-up roller 25 may be rotated by a drive force received from a motor (not shown), which may be transmitted by a drive transmission mechanism 27 constructed of meshing gears.

Arm 26 may be disposed pivotally on a base shaft 89, and vertically moved, such that arm 26 contacts or separates from input tray 20. As shown in FIG. 3, arm 26 pivots downwardly to contact input tray 20 due to its weight, so that pick-up roller 25 is brought into contact with input tray 20. When input tray 20 and output tray 21 are inserted or removed via opening 4, arm 26 is withdrawn upward. When pick-up roller 25 rotates while remaining pressed against the surface of a recording sheet on input tray 20, an uppermost recording sheet is supplied to separation plate 22 by a frictional force generated between the roller surface of pick-up roller 25 and the surface of recording sheet. The recording sheet contacts separation plate 22 at the recording sheet's leading end and is guided upward into sheet feed path 23. When the uppermost recording sheet is supplied by pick-up roller 25, a recording sheet immediately under the uppermost recording sheet may be supplied together because of friction and static electricity. The underlying recording sheet, however, contacts separation plate 22 and, thus, is prevented from being supplied together with an adjacent uppermost recording sheet.

Sheet feed path 23 comprises an outer guide surface and an inner guide surface, which may be disposed in a face-to-face (i.e., opposing) relation, except for a place at which image recording unit 24 is disposed. For example, sheet feed path 23 provided on the rear of multifunction apparatus 1 may be formed by fixing an outer guide member 90 and an inner guide member 91 in the frame. Outer guide member 90 may be provided with feed rollers 92. Feed rollers 92 may be supported rotatably on outer guide member 90, such that their axial direction is aligned in a width direction of sheet feed path 23, and their roller surfaces are exposed to outer guide member 90. Feed rollers 92 provide smooth feeding of a recording sheet that contacts the outer guide surface at a place at which sheet feed path 23 is bent in a U-shape.

As shown in FIG. 3, image recording unit 24 may be disposed in sheet feed path 23. Image recording unit 24 comprises a carriage 31 on which a recording head 30 is mounted. Recording head 30 is configured to selectively eject ink droplets of ink of each color (e.g., cyan (C), magenta (M), yellow (Y), and black (Bk)), which may be supplied from ink cartridges (not shown) provided separately from recording head 30, via ink tubes 33 (FIG. 4). When carriage 31 is moved reciprocatively, ink droplets may be ejected selectively from recording head 30 onto a recording sheet being fed on platen 34, and an image is recorded on the recording sheet.

As shown in FIG. 4, a pair of guide rails 43, 44 may be disposed in spaced relationship with each other, along the sheet feed direction, above sheet feed path 23. Guide rails 43, 44 may extend in a direction substantially perpendicular to the sheet feed direction (e.g., in left-right direction of FIG. 4). Carriage 31 may be disposed astride guide rails 43, 44 so as to reciprocate in a horizontal direction substantially perpendicular to the sheet feed direction. Guide rail 43 may be disposed on an upstream side with respect to the sheet feed direction, and have an elongated flat plate shape that is longer than the range of motion of carriage 31. A guide surface 43A, which may be part of an upper surface of guide rail 43, may be provided on the downstream side with respect to the sheet feed direction. Guide surface 43A slidably supports an upstream end portion of carriage 31.

Guide rail 44 may be disposed on a downstream side with respect to the sheet feed direction, and have an elongated flat plate of substantially the same length as guide rail 43. In guide rail 44, an upstream edge portion 45 may be bent upwardly at approximately a right angle. A guide surface 44A, which may be a portion of an upper surface of guard rail 43, may be provided on the downstream side with respect to the sheet feed direction. Guide surface 44A slidably supports a downstream end portion of carriage 31. Carriage 31 holds edge portion 45 with rollers or the like, not shown. Thus, carriage 31 may be carried slidably on guide surfaces 43A and 44A of guide rails 43 and 44, so that carriage 31 may travel in the horizontal direction perpendicular to the sheet feed direction with reference to edge portion 45 of guide rail 44.

On the upper surface of guide rail 44, a belt drive mechanism 46 may be disposed along guide rail 44. Belt drive mechanism 46 comprises a drive pulley 35, a driven pulley 36, and an endless timing belt 32 with teeth on its inside surface. Drive pulley 35 and driven pulley 36, respectively, may be disposed at opposite ends of guide rail 44 to stretch timing belt 32 therebetween. Timing belt 32 and carriage 31 may be connected, so that carriage 31 travels based on movement of belt drive mechanism 46.

Drive pulley 35 may be disposed on one end ( right side in FIG. 4) on the upper surface of guide rail 44 to rotate on a shaft, which is disposed in a direction orthogonal to guide surface 44A of guide rail 44. Although not shown in FIG. 4, a motor may be disposed under guide rail 44. The motor may apply a drive force to the shaft of drive pulley 35, and, thus, drive pulley 35 is rotated.

Timing belt 32 is stretched between drive pulley 35 and driven pulley 36. Although not shown in FIG. 4, drive pulley 35 may have spur teeth on its outer peripheral surface that mesh with the internal teeth of timing belt 32. With this meshing, the rotation of drive pulley 35 is transmitted reliably to timing belt 32, and timing belt 32 is moved circumferentially. In this embodiment, timing belt 32 is continuous. Instead, a timing belt having ends may be used. In this case, both ends of the timing belt may be connected to carriage 31.

Carriage 31 may be connected to timing belt 32. When timing belt 32 is moved, carriage 31 travels on guide rails 43 and 44 with reference to edge portion 45. Recording head 30 mounted on carriage 31 may travel in a width direction of sheet feed path 23.

An encoder strip 37 of a linear encoder (not shown) may be disposed along edge portion 45 of guide rail 44. Linear encoder may be configured to detect the encoder strip 37 by a photo interrupter 38 mounted on carriage 31. A detection signal from linear encoder may be transmitted to a control part of multifunction apparatus 1, and the movement of carriage 31 is controlled based on the detection signal received by control part.

As shown in FIGS. 3-5, a platen 34 (corresponding to a support plate of the invention) may be disposed below sheet feed path 23 to face recording head 30. Platen 34 may be provided with a plurality of ribs 94 standing vertically from a bottom surface of platen 34. Ribs 94 are narrow plate members extending along the sheet feed direction (an up-down direction of FIG. 4), and are spaced apart in a width direction of the apparatus (or a direction perpendicular to the sheet feed direction). Ribs 94 extend towards the upstream end of platen 34 with respect to the sheet feed direction. Ribs 94 are provided substantially across an upper surface of platen 34 at its upstream end.

The upper surface of platen 34, more specifically, a surface formed by vertexes of the ribs 94 may provide a support surface for the recording sheet. The upper surface or support surface of platen 34 is horizontally flat. In this manner, recording sheet fed to platen 34 is supported horizontally. Platen 34 is disposed in a central portion of apparatus 1 where a recording sheet passes an area where carriage 31 can move. Platen 34 may have width corresponding to a maximum width of a recording sheet fed that may be fed into multifunction apparatus 1, such that both sides of any recording sheet fed into apparatus 1 pass over platen 34.

Figure 7:
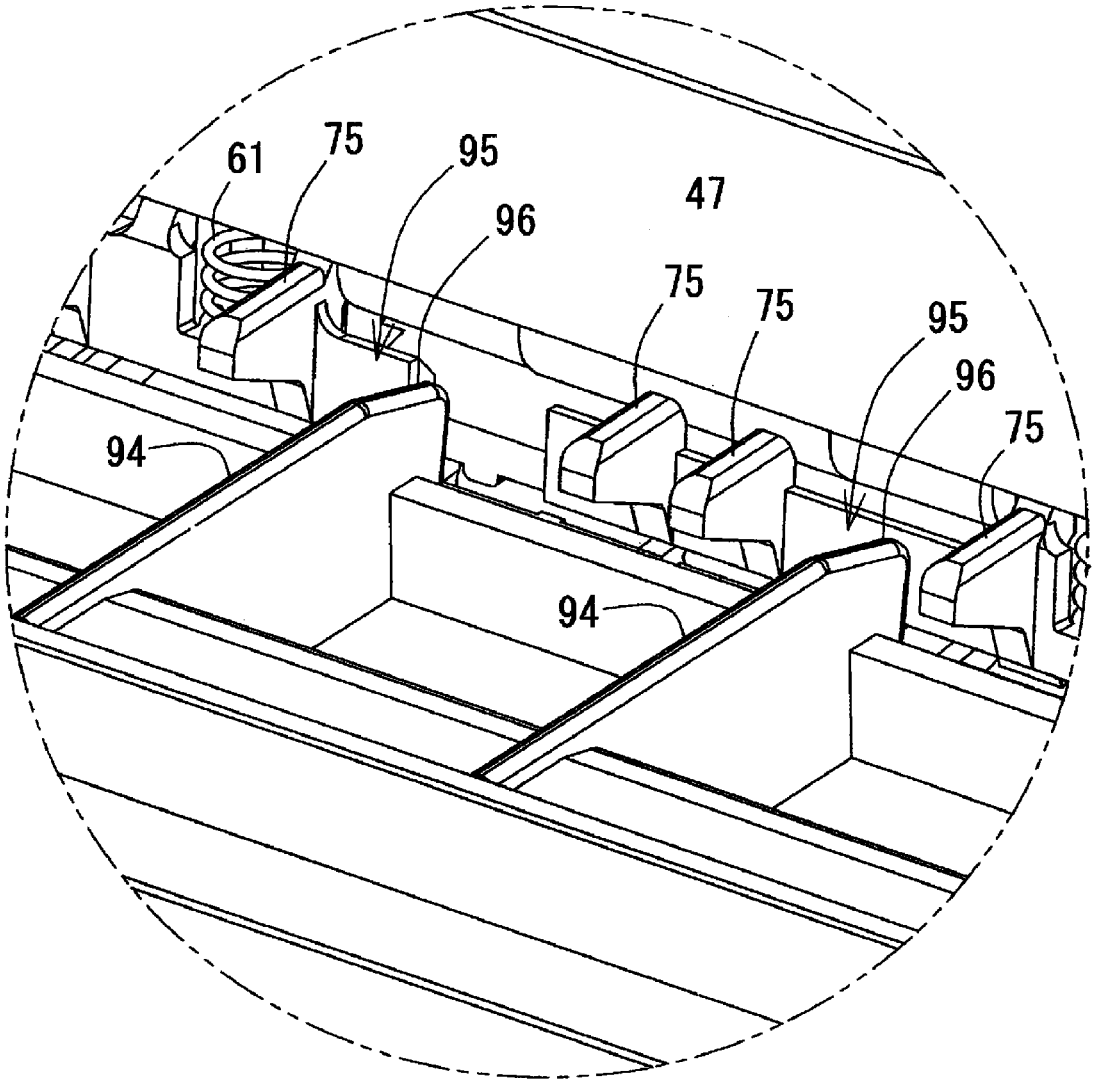
FIG. 7 is a partial, enlarged view of an upstream end of ribs of a platen with respect to a sheet feed direction.

As shown in FIG. 7, an end 95 of each rib 94, which may be provided on an upstream side with respect to the sheet feed direction, comprises an inclined surface 96. Inclined surface 96 may be inclined downwardly from the vertex of the corresponding rib 94, where a recording sheet is supported, toward the upstream side with respect to the sheet feed direction. Inclined surface 96 may be configured to guide the leading end of a recording sheet to the upper surface of platen 34 smoothly.

As shown in FIG. 4, maintenance units such as a purge mechanism 39 and a waste ink tray 40 may be disposed outside an area where recording sheet is fed or image is recorded by recording head 30. Purge mechanism 39 may be configured to remove bubbles and foreign matter from nozzles, not shown, disposed on the lower surface of recording head 30 by suction. Purge mechanism 39 comprises a cap 41. To remove bubbles from recording head 30, carriage 31 may be moved to position recording head 30 above cap 41, which may be moved upwardly to cover the nozzles of recording head 30, and ink may be drawn from the nozzles of recording head 30 by a pump connected to the cap 41.

Waste ink tray 40 may be configured to receive ink droplets ejected from recording head 30 by a flushing operation. The waste ink tray 40 may be disposed integrally with the platen 34. These maintenance units perform maintenance operations to remove bubbles and mixed ink remaining recording head 30.

Ink may be supplied to recording head 30 via ink tubes 33 connected to ink cartridges for respective colors (not shown). Each ink tube 33 may be of a flexible synthetic resin configured to bend in accordance with the motion of formed carriage 31.

Each ink tube 33 may be fixed, near a central portion with respect to the width of the apparatus 1, by a fixing clip 29 disposed on an apparatus frame. As each ink tube 33 is not fixed from fixing clip 29 to carriage 31, it may be moved in accordance with the motion of carriage 31.

As shown in FIGS. 3, 5, and 6, a feed roller pair 54 (an example of a feed means of the invention) may be disposed on the upstream side of image recording unit 24. Feed roller pair 54 may comprise a drive roller 47 and pinch rollers 48 (corresponding to a driven roller of the invention) disposed below drive roller 47. Pinch rollers 48 may be rotatably supported by a pinch roller holder 56 (corresponding to a first support member of the invention) so as to press drive roller 47 with a predetermined urging force. When a recording sheet passes through a pressing position where drive roller 47 and pinch roller 48 press one another, pinch rollers 48 withdraw by a thickness of recording sheet to sandwich recording sheet with driven roller 47, and feed it onto platen 34. Thus, the rotational force of drive roller 47 is reliably transmitted to recording sheet.

Pinch roller holder 56 is rollingly supported by a holder support member 57 (corresponding to a second support member of the invention) with respect to the sheet feed direction. Holder support member 57 may be integrally formed with an inside frame 58. When a recording sheet is fed by feed roller pair 54, pinch roller holder 56 may be rolled to a feed position (a first position) on a downstream side shown in FIG. 15. When the trailing end of recording sheet comes out from feed roller pair 54, pinch roller holder 56 may be rolled to a receding position (a second position) on an upstream side shown in FIG. 14.

An ejection roller pair 55 may be disposed on a downstream side of image recording unit 24. Ejection roller pair 55 may comprise drive rollers 49 and spur rollers 50. Each spur roller 50 may be disposed to face a corresponding drive roller 49 from above, and pressed in contact thereto. A recording sheet on which the image has been recorded is held and fed by drive rollers 49 and the spur rollers 50. As with pinch rollers 48, spur rollers 50 may be configured to be urged towards corresponding drive rollers 49 and in contact with the recording sheet on which the image has been recorded. Thus, the surfaces of spur rollers 50 may be formed with spur-like patterns.

As shown in FIGS. 5 and 6, a pulley 59 may be disposed on one end of drive roller 47. A drive force may be transmitted from pulley 59 to drive roller 47, and drive roller 47 is thus rotated. The drive force from pulley 59 may be transmitted via a transmission mechanism, not shown, to drive rollers 49, and drive rollers 49 are thus rotated. The rotation of drive rollers 47 and 49 may be synchronized. As pulley 59 is controlled, drive rollers 47 and 49 may be intermittently driven. Thus, a recording sheet fed on to platen 34 may be intermittently fed by a predetermined linefeed width. Drive rollers 47 and 49 may be rotated when an encoder, not shown, detects an encoder disk 51, which may be provided on drive roller 47, and pulley 59 is controlled based on a detection signal from the encoder.

Recording sheet sandwiched between drive roller 47 and the pinch rollers 48 may be intermittently fed on the platen 34 by a predetermined linefeed width. Recording head 30 scans the recording sheet each linefeed, and image recording is started from the leading end of recording sheet. The leading end of recording sheet, onto which image recording has been performed is sandwiched between drive rollers 49 and spur rollers 50. Namely, the recording sheet is intermittently fed by the linefeed width while it is sandwiched between drive rollers 49 and spur rollers 50 at the leading end, and between drive roller 47 and pinch rollers 48 at the trailing end, and image recording is performed every linefeed by recording head 30.

As the recording sheet is further fed, the trailing end thereof may be released from drive roller 47 and pinch rollers 48. That is, the recording sheet is held only by drive rollers 49 and spur rollers 50 and intermittently fed with the linefeed width, and the image is recorded by recording head 30 every linefeed. After the image is recorded upon the recording sheet, drive rollers 49 may be continuously rotated. As a result, the recording sheet held by drive rollers 49 and spur rollers 50 is ejected to the output tray 21. As the trailing end of the recording sheet is released from drive roller 47 and pinch rollers 48, pinch roller holder 56 may roll to the receding position (second position) on the upstream side shown in FIG. 14.

Figure 8:
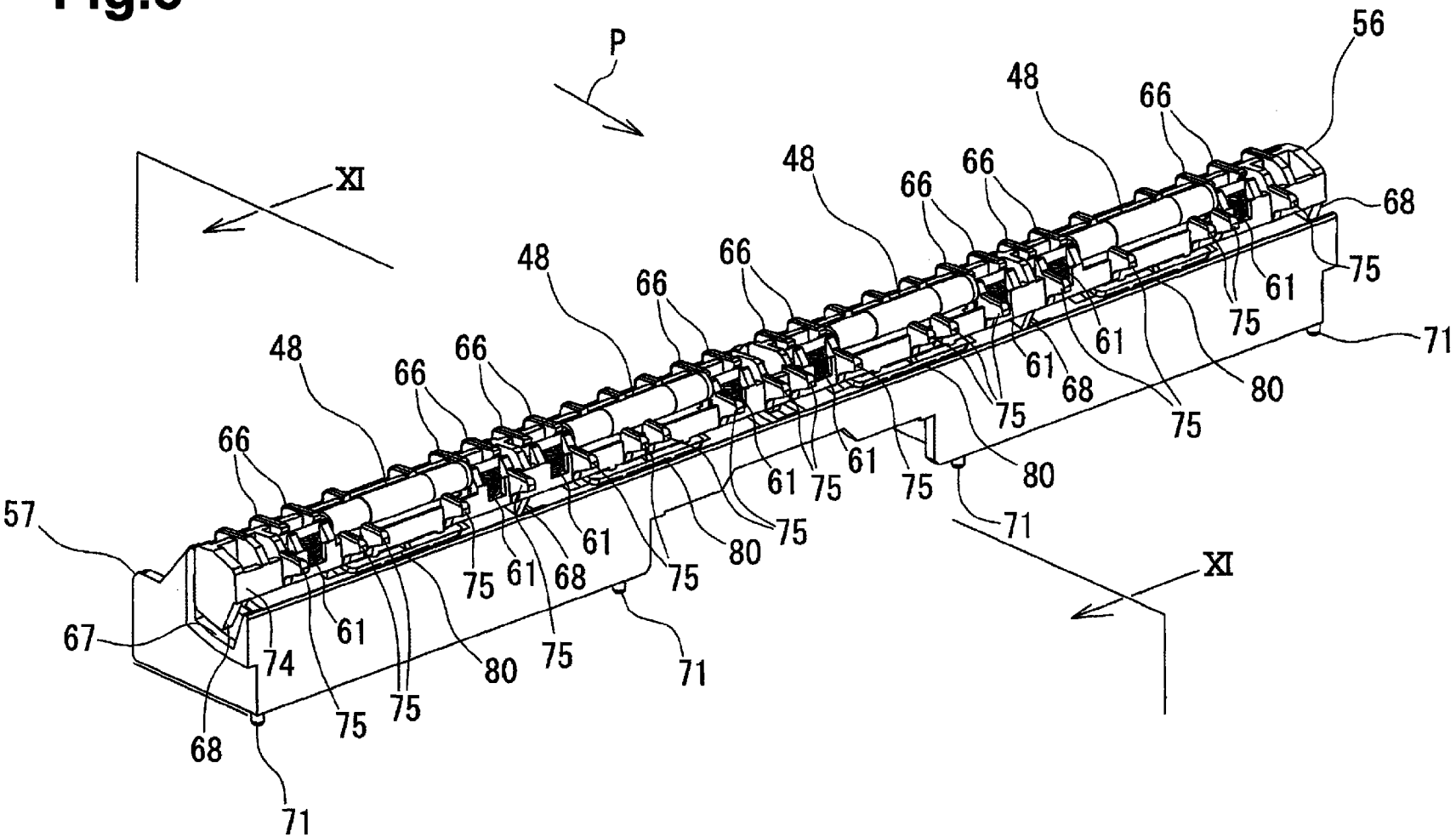
FIG. 8 is a perspective view in which a pinch roller holder is supported by a holder support member.

With reference to FIGS. 8-15, holder support member 57 and pinch roller holder 56, and a structure supporting pinch roller holder 56 are described in detail. In FIG. 8, an arrow indicated by P is the sheet feed direction.

Figure 9:
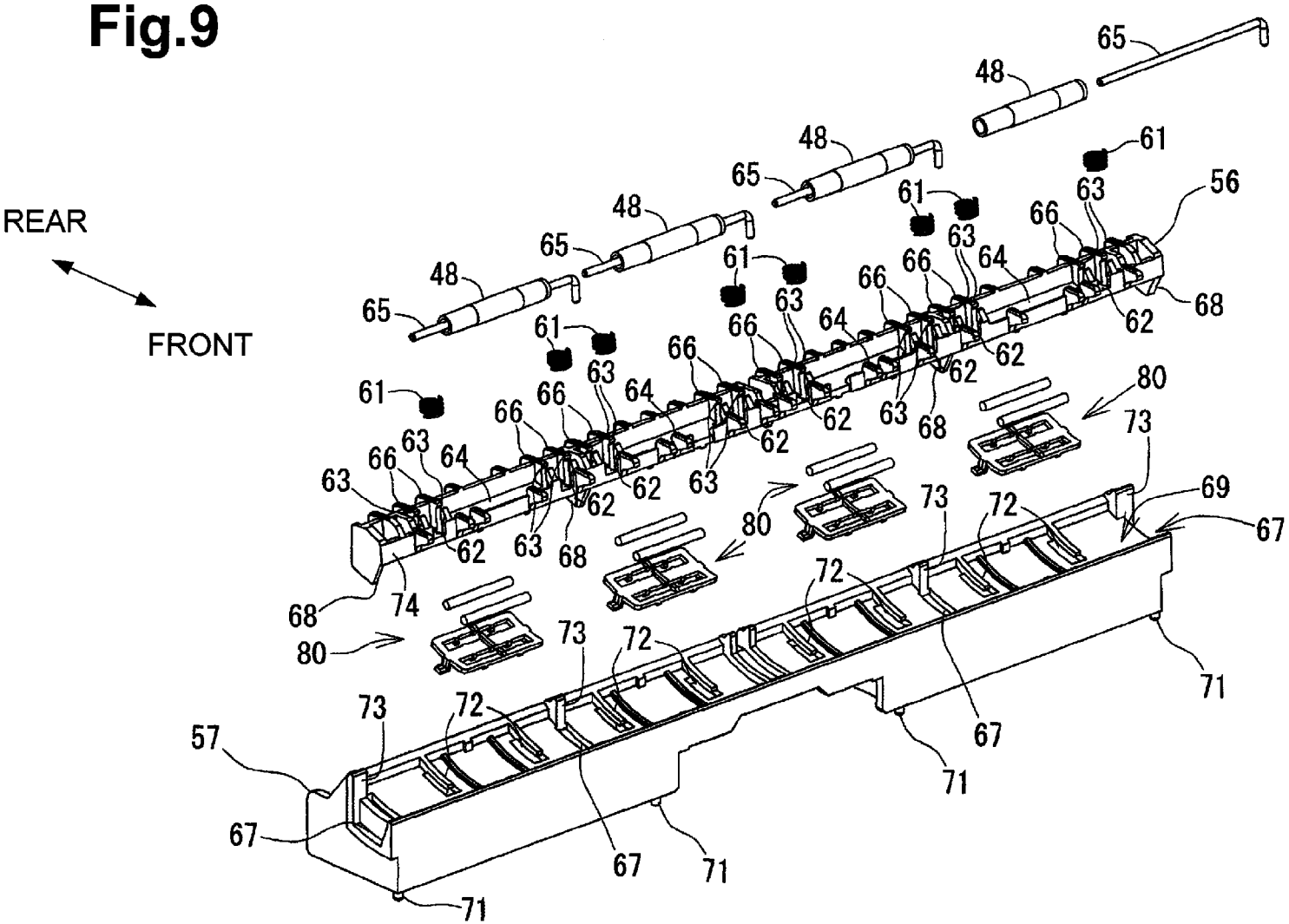
FIG. 9 is an exploded view of the holder support member and the pinch roller holder.

As shown in FIGS. 8 and 9, pinch roller holder 56 may be disposed so that its length in an axial direction matches the width direction of a recording sheet. An upper surface of pinch roller holder 56 which faces drive roller 47, may be provided with four roller storage chambers 64 and eight spring storage chambers 62. Roller storage chambers 64 may be spaced apart along the axial direction of pinch roller holder 56. Spring storage chambers 62 may be formed adjacent to both sides of each roller storage chamber 64. Each pinch roller 48 may be disposed in a corresponding roller storage chamber 64 such that a rotary shaft 65 matches the axial direction of pinch roller holder 56. Coil springs 61 (an example of an urging member of the invention) may be disposed in the spring storage chambers 62 under compression. The number of pinch rollers 48 and coil springs 61 and a method of arranging pinch rollers 48 and coil springs 61 may vary as appropriate. Instead of coil springs 61, elastic members such as a plate spring may be used as an urging member.

Figure 10:
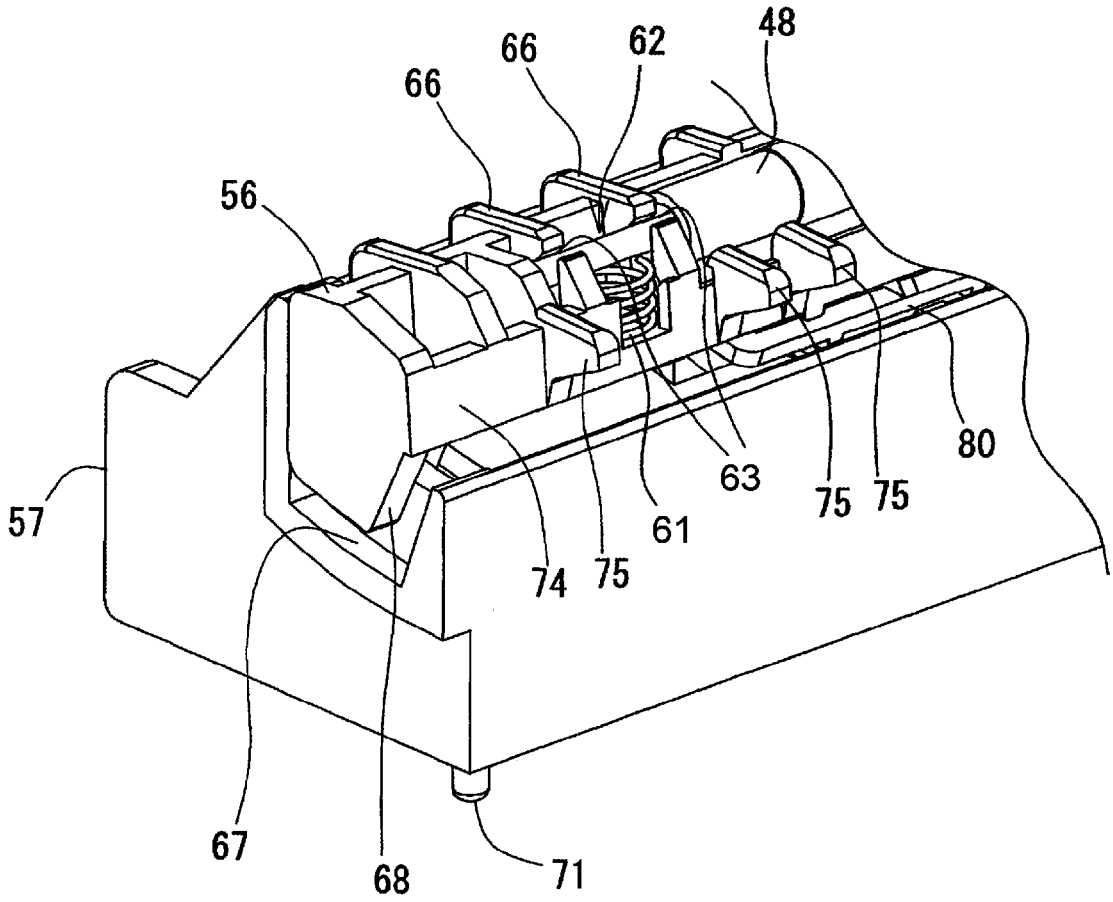
FIG. 10 is a partial, enlarged view of the pinch roller holder.

As shown in FIGS. 8-10, each spring storage chamber 62 may be defined by partition plates 66 disposed on both sides of spring storage chamber 62. Partition plates 66 may be formed with bearings 63. Rotary shafts 65 of pinch rollers 48 may be supported by the bearings 63. Each bearing 63 may be vertically recessed. An upper end portion of each bearing 63 may be shaped slightly smaller than a diameter of rotary shaft 65. When the rotary shaft 65 is pressed into the bearing 63, the upper end portion of each bearing 63 elastically opens to receive rotary shaft 65 therein. When rotary shaft 65 is completely inserted into each bearing 63, the upper end portion of bearing 63 returns to its original shape to support rotary shaft 65. In that manner bearings 63 support rotary shaft 65 to permit movement in a vertical (up-down) direction.

Coil spring 61 may be disposed in a corresponding spring storage chamber 62, and the rotary shaft 65 of each pinch roller 48 may be inserted into the bearing 63. Thus, coil spring 61 is compressed in spring storage chamber 62. The spring force of compressed coil spring 61 urges pinch roller 48 in an upward direction toward drive roller 47. Thus, when a recording sheet is fed, pinch roller 48 lowers against the urging force of coil spring 61 according to the thickness of the recording sheet being fed.

Four protrusions 68 may be formed on the bottom surface of pinch roller holder 56. Protrusions 68 are configured to engage four corresponding grooves 67 (FIG. 9) formed in the holder support member 57. Protrusions 68 may be thin flat members protruding downward from the bottom surface of pinch roller holder 56. Protrusions 68 extend in a short or crosswise direction of the pinch roller holder 56. Protrusions 68 are inserted into corresponding grooves 67 with predetermined amount of play so that pinch roller holder 56 moves (within a specified range) relative to holder support member 57 in the sheet feed direction.

Figure 14:
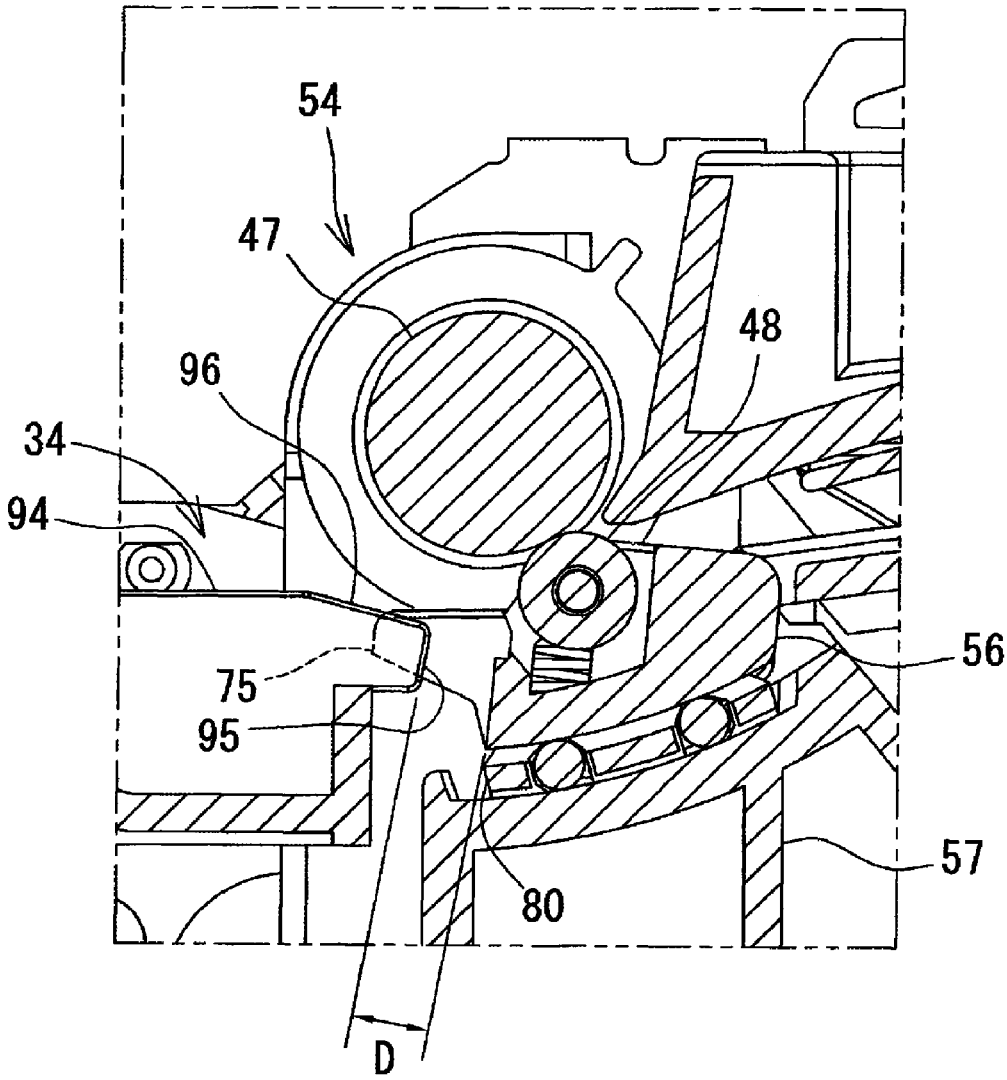
FIG. 14 is a partial, cross-sectional view showing that the pinch roller holder is placed at a receding position.
Figure 15:
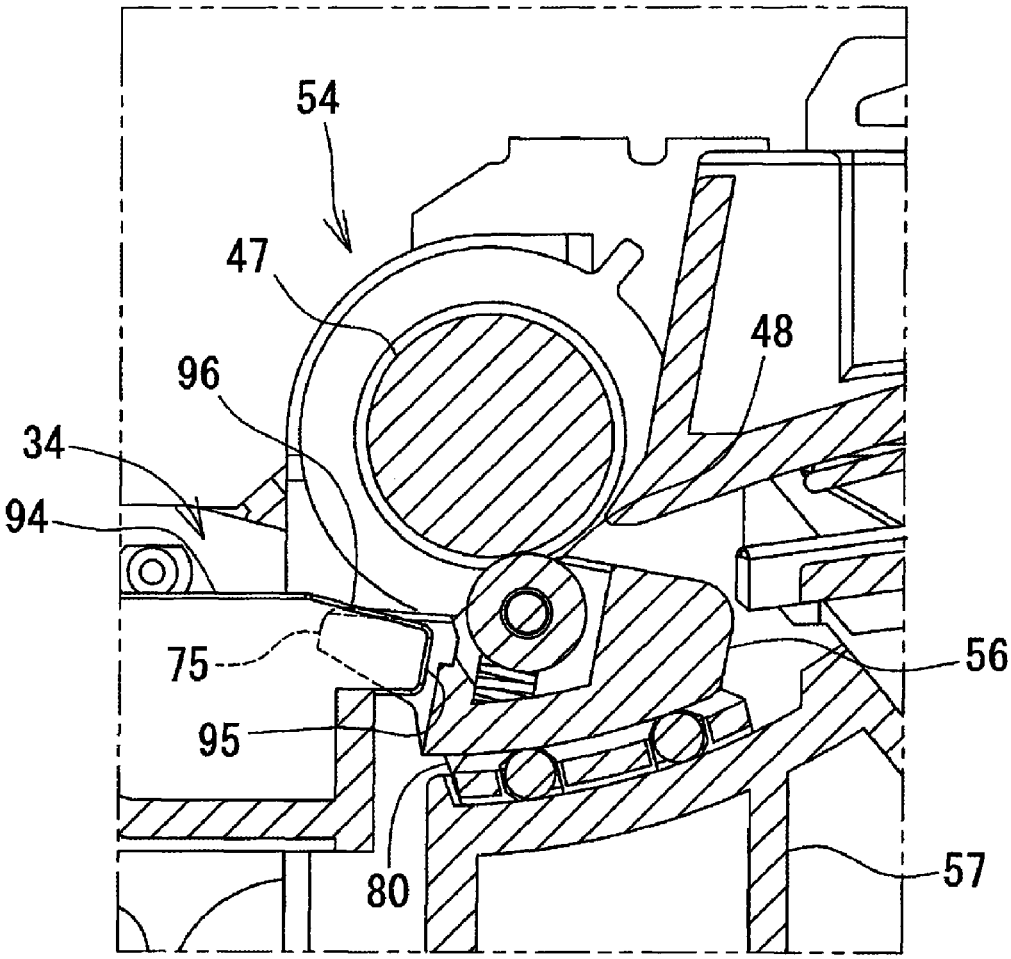
FIG. 15 is a partial, cross-sectional view showing that the pinch roller holder is placed at a feeding position.

A side surface 74 of pinch roller holder 56, which faces the downstream side in the sheet feed direction, may be provided with guide ribs 75 (corresponding to guide members of the invention) extending in a direction substantially perpendicular to the face of side surface 74. Each guide rib 75 protrudes towards platen 34 located downstream from pinch roller holder 56 in the sheet feed direction as shown in FIGS. 14 and 15. Guide ribs 75 may be integrally formed with the pinch roller holder 56. In this embodiment, twenty (20) guide ribs 75 extend from pinch roller holder 56 toward platen 34.

An upper surface of each guide rib 75 is constituted as a guide surface that may be configured to face the leading end of a recording sheet toward platen 34 when the recording sheet is fed to guide rib 75. The upper surface of each guide rib 75 is flat, similar to the upper surface of platen 34.

The number of guide ribs 75 and their intervals at which they are arranged may vary according to the size of multifunction apparatus 1 and the maximum size of a recording sheet that can be fed into the multifunction apparatus 1. In the embodiment, as shown, however, guide ribs 75 are disposed at least at positions to support both sides of any standard-sized recording sheets that are to be supported on platen 34. Thus, even if a recording sheet hanging down at both sides is fed toward platen 34, both sides of the recording sheet are supported on the upper surfaces of guide ribs 75. Thus, damage to the recording sheet or jamming resulting from recording sheet being fed with both sides being curved downward may be prevented. Exemplary recording sheets used in multifunction apparatus 1 may comprise, for example, A sizes, B sizes, letter size, legal size, and postcard size.

In this embodiment, guide ribs 75 are disposed in accordance with the above-described exemplary recording sheets. Guide ribs 75 may be disposed so as to support both ends of a recording sheet whose width is the maximum (that is, a legal-size recording sheet in this embodiment) among the standard sizes where image recording is possible at printer portion 2 of multifunction apparatus 1. A wide recording sheet is liable to hang down at both ends, but as long as guide ribs 75 support at least both ends of recording sheet, jamming of and damage to the recording sheet may be prevented.

Pinch roller holder 56 is supported by the holder support member 57 to roll between the receding position shown in FIG. 14 and the feeding position shown in FIG. 15. When pinch roller holder 56 is located in the receding position, a clearance D is provided between end 95 of rib 94 provided on an upstream side of platen 34 with respect to the sheet feed direction and pinch roller holder 56, as shown in FIG. 14. In this embodiment, clearance D is closed by guide ribs 75. Thus, if a recording sheet being fed by feed roller pair 54 attempts to enter the clearance D, its progress is blocked by guide ribs 75. Simultaneously, the leading end of recording sheet is directed towards platen 34 by guide ribs 75. More specifically, the leading end of recording sheet is directed to inclined surface 96 formed on end 95 of rib 94. Thus, recording sheet is guided smoothly to the upper surface of rib 94 along inclined surface 96. In this manner, recording sheet is fed to platen 34 so that jamming is prevented.

As shown in FIG. 7, guide ribs 75 are disposed in positions corresponding to a clearance formed between adjacent ribs 94, so as not to interfere with ribs 94 extending to end 95 on the upstream side of platen 34. In this embodiment, regardless of the position of pinch roller holder 56, which is supported so as to be rolled along the sheet feed direction, a protruding length of the guide ribs 75 is provided so that guide ribs 75 can enter the space between ribs 94. In other words, even when pinch roller holder 56 is maintained in the receding position, guide ribs 75 are disposed so as end 95 of the platen 34 as shown in FIG. 14. Thus, regardless of the position of pinch roller holder 56, guide ribs 75 are normally inserted into the space between ribs 94 while pinch roller holder 56 is supported by holder support member 57 (FIGS. 14 and 15). When pinch roller holder 56 is rolled on holder support member 57, guide ribs 75 reciprocate with respect to the sheet feed direction. During reciprocative movement, guide ribs 75 advance to or recede from the space between the ribs 94.

As shown in FIGS. 14 and 15, the upper surface (or the guide surface) of guide rib 75 may be located below the upper surface of platen 34. Thus, even when a recording sheet is fed toward guide rib 75, the leading end of a recording sheet is guided smoothly to platen 34. The recording sheet directed to platen 34 ascends inclined surface 96 formed on end 95 of platen 34. In this embodiment, guide rib 75 is disposed so that its upper surface is below the upper surface of platen 34 and above the lower end of inclined surface 96.

Figure 11:
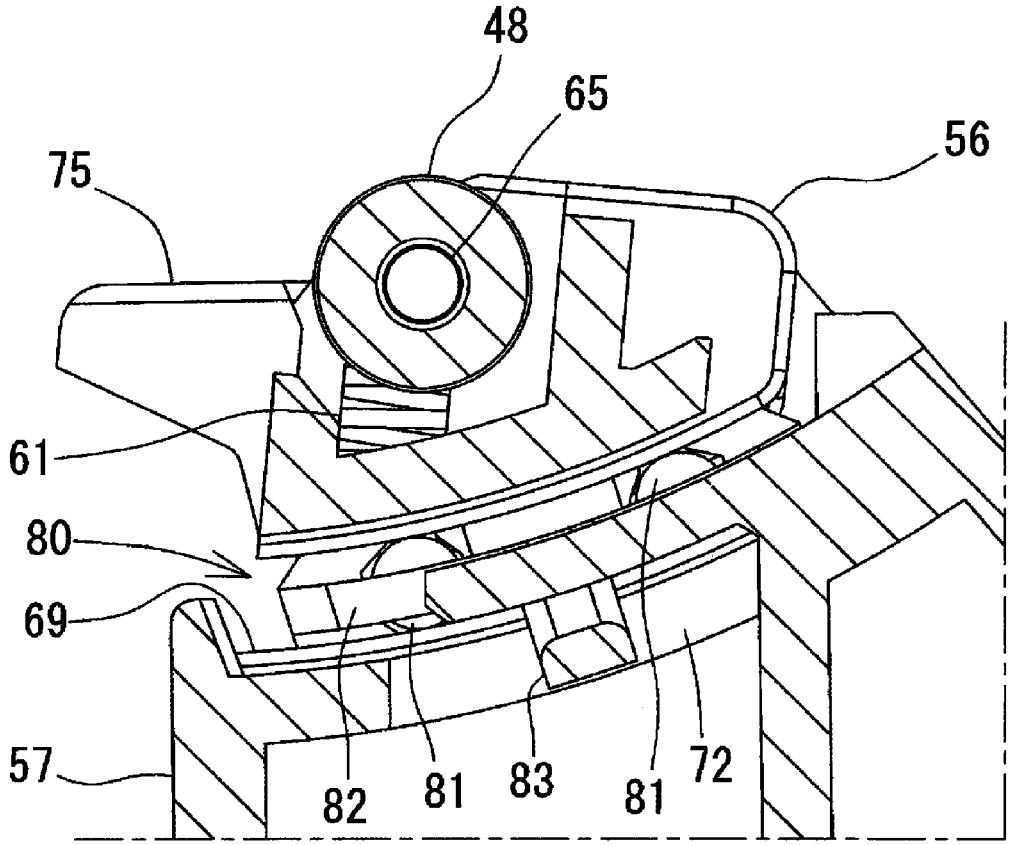
FIG. 11 is a cross sectional view, taken along the line XI-XI of FIG. 8.
Figure 13:
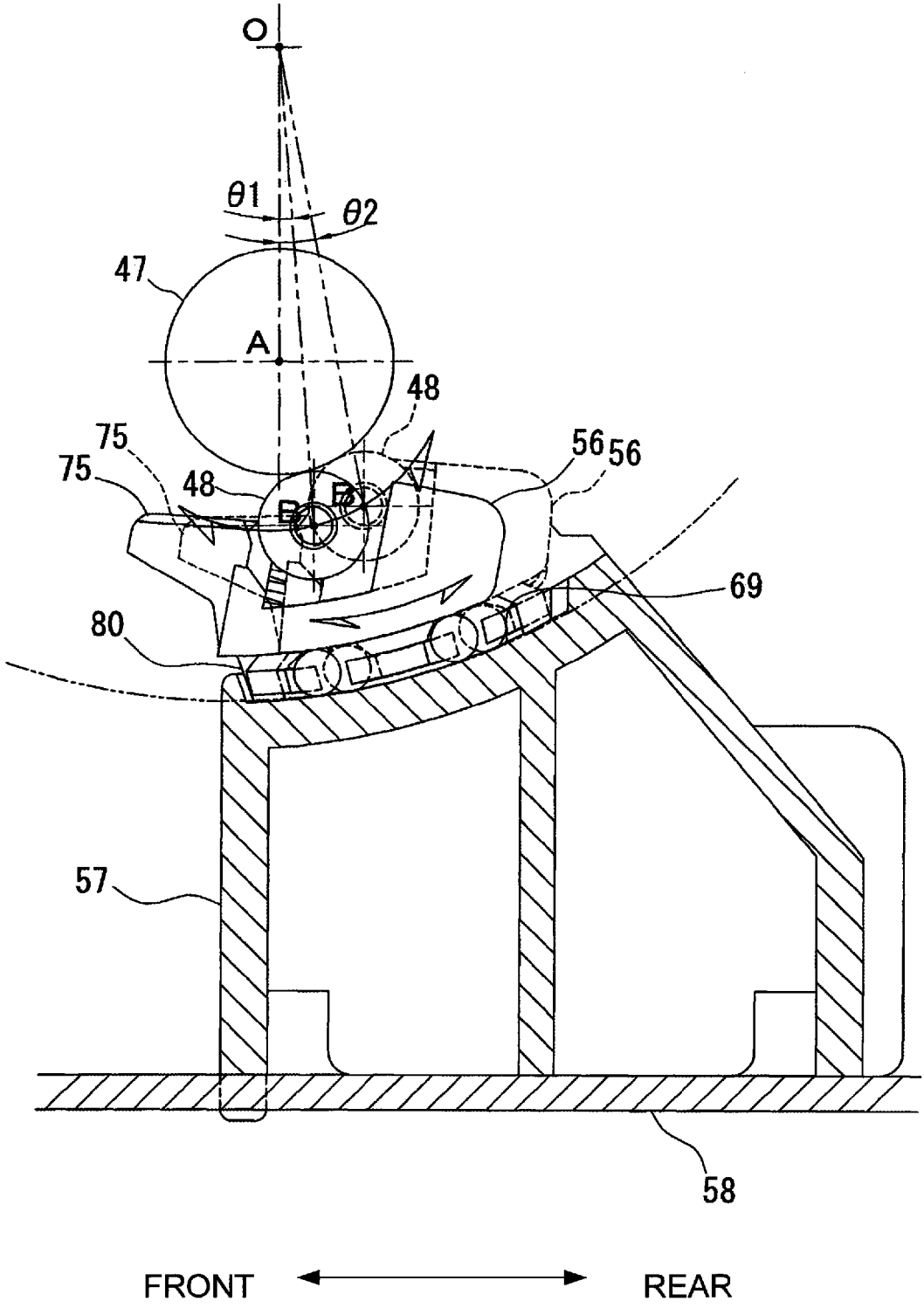
FIG. 13 is a partial, enlarged view showing a moving range of the pinch roller holder.

As shown in FIGS. 8 and 9, holder support member 57 may be similar in length to pinch roller holder 56, and is disposed in the inside frame 58 (FIG. 3) so that its longitudinal direction matches the width direction of a recording sheet. More specifically, protrusions 71 formed on the lower surface of holder support member 57 are engaged in holes, not shown, of the inside frame 58, so that holder support member 57 is fixed in place in inside frame 58. As shown in FIGS. 11 and 13, a curved surface 69 (corresponding to a support surface of the invention) may be formed on the upper surface of holder support member 57, which supports pinch roller holder 56 from its lower surface (corresponding to a support part of the invention) with a roller bearing 80 disposed on the curved surface 69.

As shown in FIG. 13, curved surface 69 of holder support member 57 slopes downward from the upstream side to the downstream side with respect to the sheet feed direction. Curved surface 69 has an arc shape that substantially conforms to an outer periphery of a cylindrical path about an axis of revolution passing through a point O shown in FIG. 13 (hereinafter referred to as a "center of revolution O"). The center of revolution O is included in a vertical plane passing through a center of rotation A of drive roller 47. Thus, when pinch roller holder 56 is moved along curved surface 69, pinch roller holder 56 rolls around the center of revolution O. At this time, as pinch rollers 48 are urged by coiled springs 61, they move along the circumferential surface of drive roller 47 while remaining pressed into contact thereto. A distance between a center of revolution O and the curved surface 69 is greater than a distance between a center of revolution B and the curved surface 69.

Figure 12:
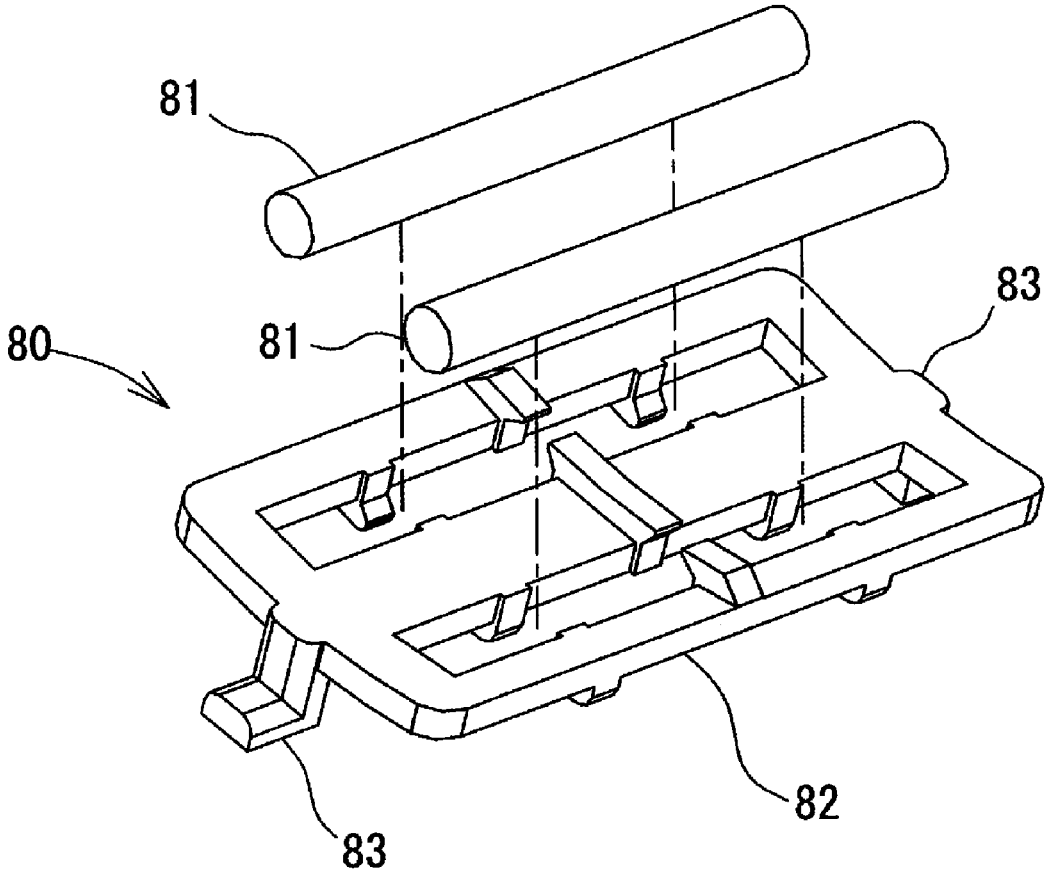
FIG. 12 is an exploded view showing a structure of a roller bearing.

As shown in FIGS. 11 and 12, roller bearing 80 may comprise two rollers 81 (corresponding to rotating member of the invention) and a roller support member 82 that supports rollers 81 rotatably in an integrated manner. Roller support member 82 supporting rollers 81 may be attached to curved surface 69 of the holder support member 57. More specifically, L-shaped engaging catches 83 may be formed on roller support member 82 to engage with engaged portions 72 (FIG. 9) formed on curved surface 69, so that roller support member 82 is attached to the curved surface 69. As shown in FIGS. 8 and 9, four roller bearings 80 are spaced along the longitudinal direction of holder support member 57. Pinch roller holder 56 is supported by holder support member 57, with the roller bearings 80 attached to curved surface 69, so that pinch roller holder 56 is rollable on curved surface 69. In this embodiment, the roller bearings 80 rollably support pinch roller holder 56. Alternatively, curved surface 69 of holder support member 57 or the bottom surface of pinch roller holder 56 may be integrally formed with a rotating member. For example, a known roller bearing or ball bearing may be embedded in curved surface 69 or the bottom surface of pinch roller holder 56. Furthermore, pinch roller holder 56 may be configured to slide on holder support member 57, thereby not using any rotating members such as rollers 81.

Grooves 67, which are engageable with the corresponding protrusions 68, may be formed on curved surface 69. A length of the grooves 67 is fully longer than a length of corresponding protrusions 68 with respect to the crosswise direction of pinch roller holder 56. Ribs 73 are formed on one end of grooves 67. Ribs 73 extend upwardly from inner surfaces on the rearward end of grooves 67 over curved surface 69. Ribs 73 are configured to limit a rearward movement (toward the upstream side with respect to the sheet feed direction) of pinch roller holder 56. Pinch roller holder 56 is supported by holder support member 57 so as to move in the crosswise direction with protrusions 68 engaged in grooves 67. When frontward ends of protrusions 68 and frontward inner walls of grooves 67 are brought into contact with each other, a frontward movement (toward the downstream side with respect to the sheet feed direction) of pinch roller holder 56 is limited. When the rearward ends of protrusions 68 and ribs 73 are brought into contact with each other, the rearward movement of pinch roller holder 56 is limited.

In this embodiment, as shown in FIG. 13, a rolling movement of the pinch roller holder 56 is limited between the feeding position (indicated by a solid line) and the receding position (indicated by a dotted line). At the feeding position, pinch roller holder 56 is disposed at a position where an angle formed between a vertical plan passing through the center of revolution O and a line passing through O and B is θ1 toward the rear of drive roller 47. At the receding position, the pinch roller holder 56 is disposed at a position where the angle formed between the vertical plan passing through the center of revolution O and the line passing through O and B is θ2 (>θ1). Protrusions 68 and the frontward inner walls of grooves 67, which limit the frontward movement of pinch roller holder 56, correspond to a first controlling member of the invention. Protrusions 68 and ribs 73, which limit the rearward movement of the pinch roller holder 56, correspond to a second controlling member of the invention.

As pinch roller holder 56 and holder support member 57 are configured as described above, pinch roller holder 56 is rolled to the feeding position when a recording sheet is fed while being held by feed roller pair 54, and the pinch roller holder 56 is rolled to the receding position when the trailing end of recording sheet is released from feed roller pair 54. Pinch roller holder 56 is provided with guide ribs 75 that are advanced or receded in the corresponding spaces between ribs 94 in accordance with the movement of pinch roller holder 56. Thus, clearance D (FIG. 14) formed between platen 34 and pinch roller holder 56 is blocked, thereby preventing jamming in clearance D.

Figure 16:
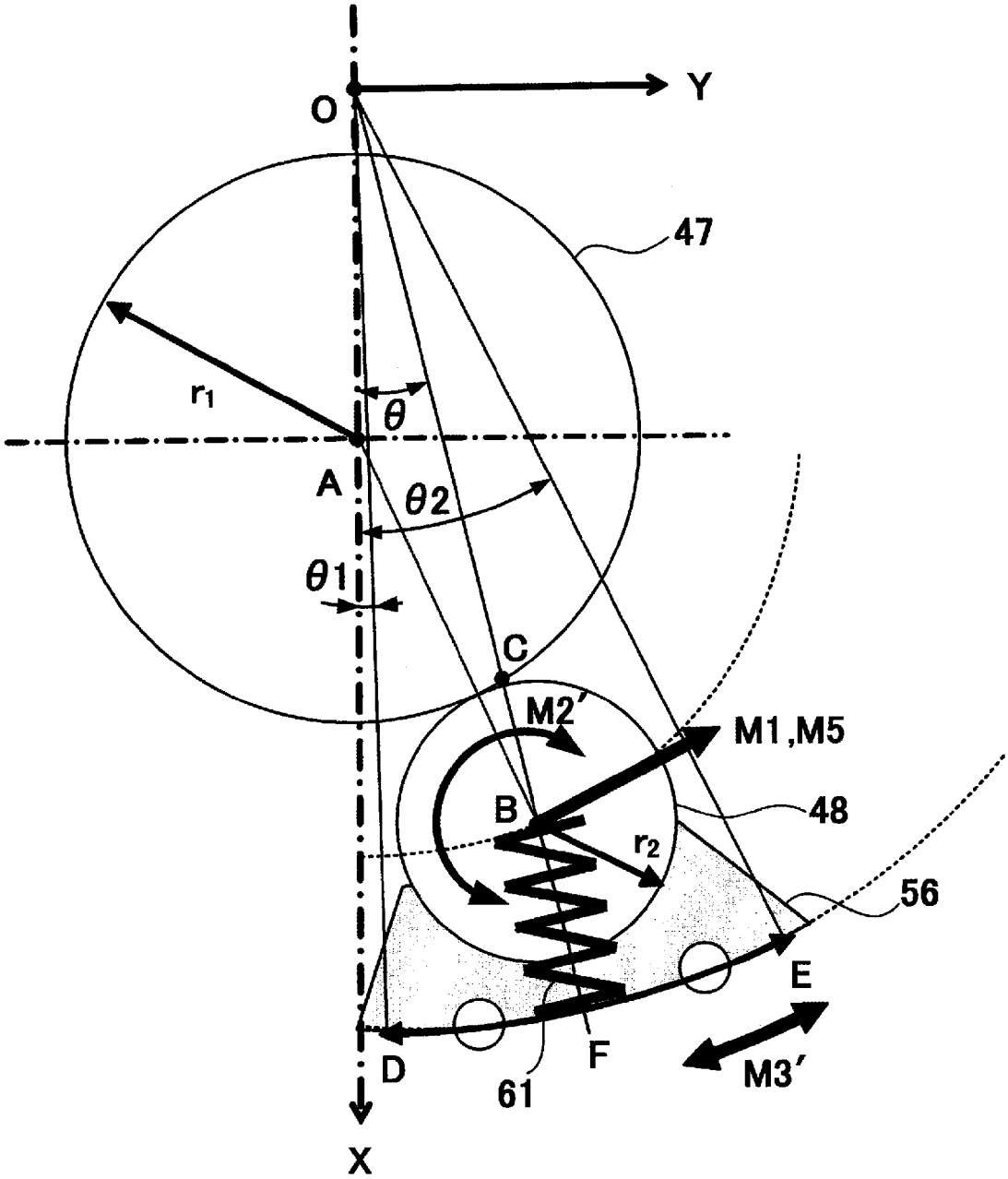
FIG. 16 is a cross-sectional view showing a drive roller and a pinch roller on x-y coordinates where a center O is an origin.
Figure 17:
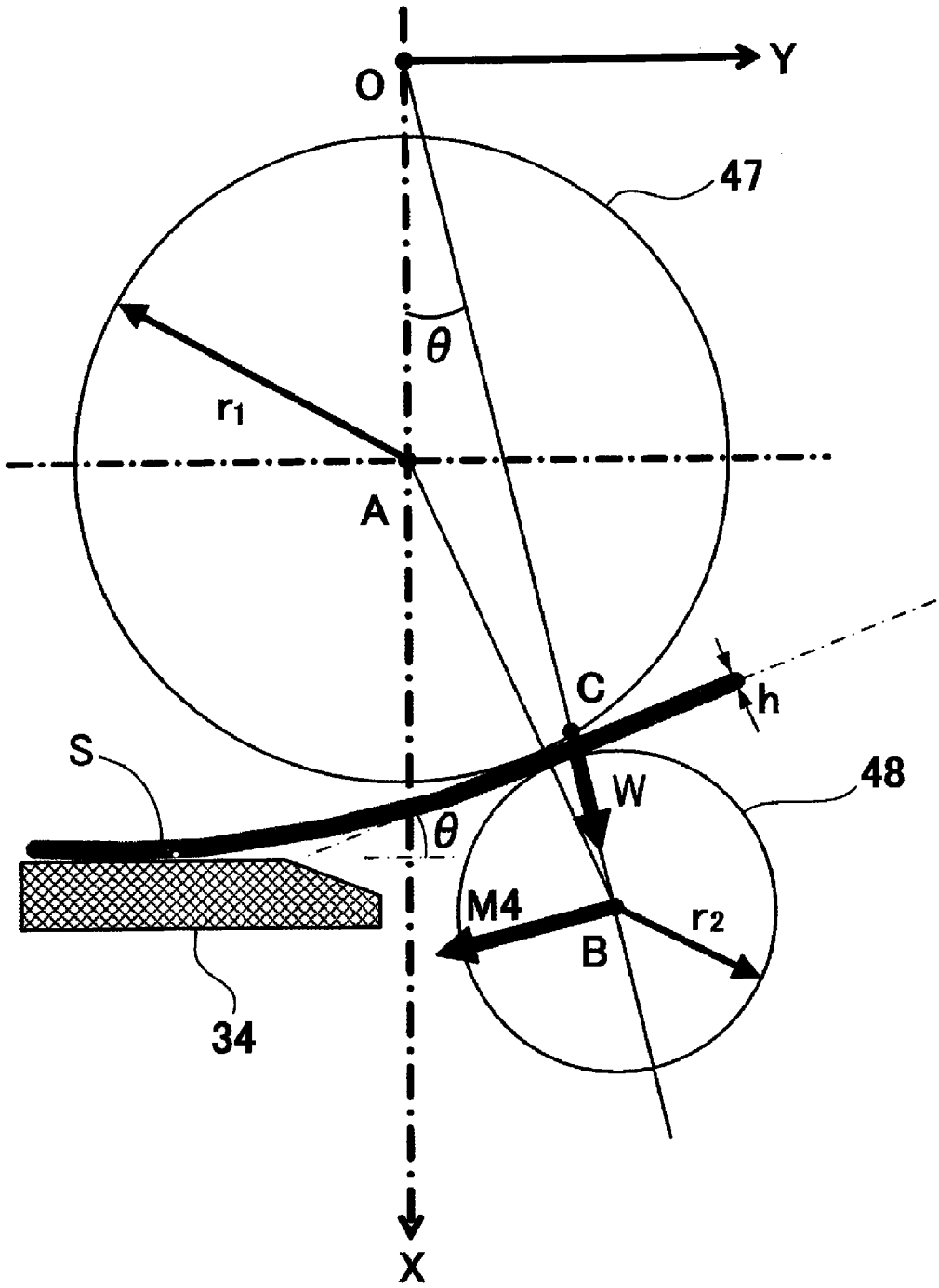
FIG. 17 is a cross-sectional view showing a recording sheet is held between drive roller and the pinch roller shown in FIG. 16.
Figure 18A:
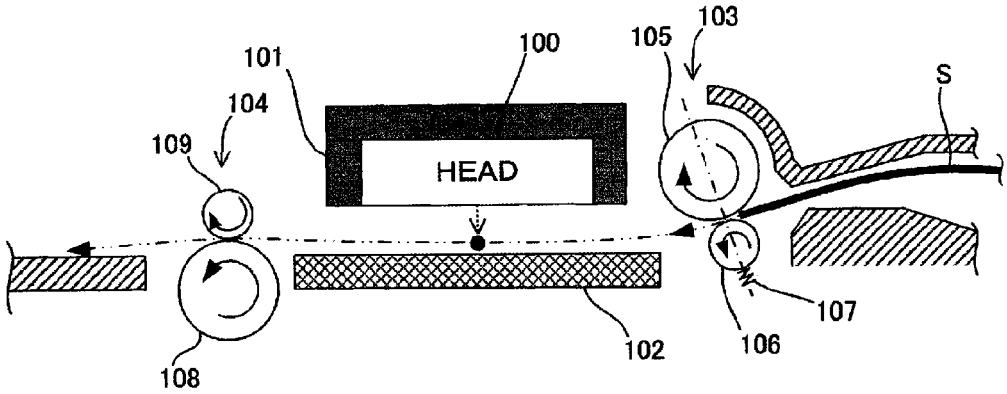
FIGS. 18A, 18B, and 18C are schematic views showing a known image recording method.
Figure 18B:
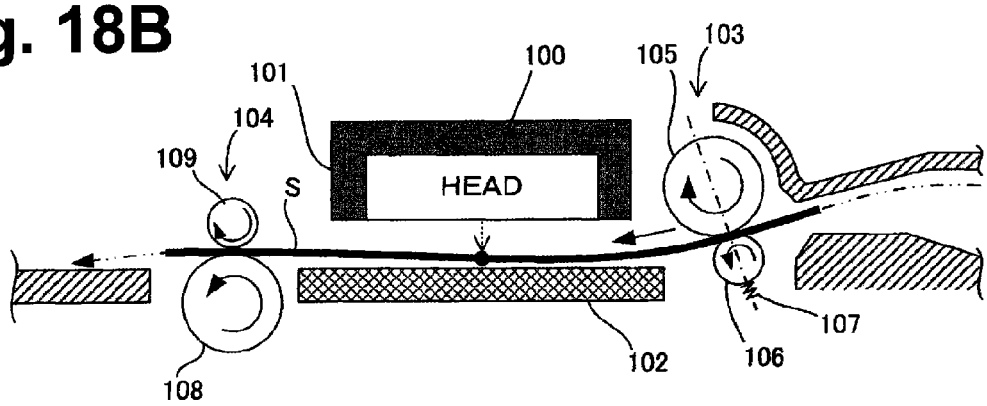
Figure 18C:
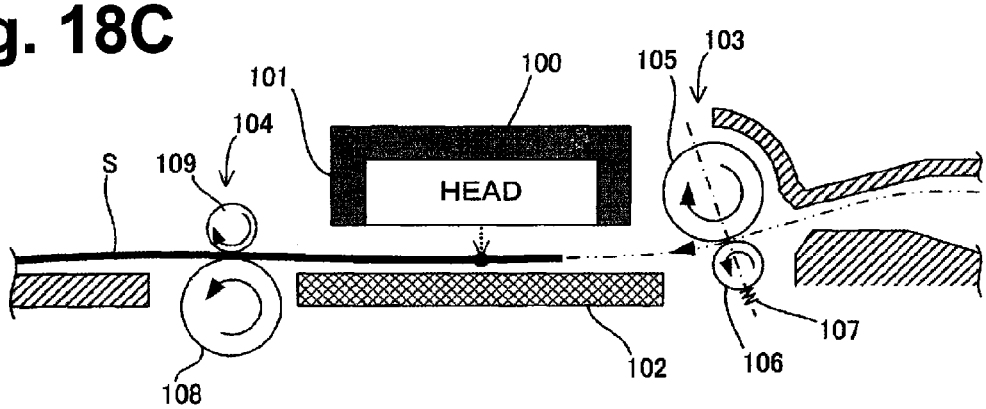

The principle of rolling of pinch roller holder 56 is now described with reference to FIGS. 16 and 17. FIG. 16 is a cross-sectional view showing drive roller 47 and pinch roller 48 on the x and y coordinates and identifying a center O as a point of origin. FIG. 17 shows that a recording sheet indicated with S is sandwiched between drive roller 47 and pinch roller 48 shown in FIG. 16. Here, a center of rotation of drive roller 47 is A, a radius of drive roller 47 is r1, a center of rotation of pinch roller 48 is B, and a radius of pinch roller 48 is r2. Center A is located on the x-axis, the origin O is located on a point apart a distance greater than the radius r1 of drive roller 47 in a negative direction on the x-axis from center A. The origin O coincides with a center of the curve of curved surface 69. That is, the origin O coincides with the center of revolution O described above. Pinch roller holder 56 is rollingly movable around the origin O between a position D that advances θ1 (≧0) counterclockwise from the x-axis and a position E that advances θ2 (>θ1) counterclockwise from the x-axis. Position D corresponds to the feeding position, and position E corresponds to the receding position. In other words, an imaginary plane (a plane including the x-axis and perpendicular to the surface of 16) including the center of rotation A of drive roller 47 and the center of revolution O is defined, and pinch roller holder 56 is rollingly movable between: the position D that advances ↓1 (≧0) from the x-axis toward downstream in the feeding direction; and the position E that advances θ2 (>θ1) from the x-axis toward upstream in the feeding direction. For the sake of convenience, the centers O, A, and B are defined as shown in FIGS. 16 and 17, however, center positions of drive roller 47, the pinch roller 48, and curved surface 69 are not limited to the above described positions.

An angle between a segment OA and a segment OB when pinch roller 48 is moved to a specified position is identified as θ. Angle θ is equal to or greater than θ1 and is equal to or smaller than θ2 (θ1≦θ≦θ2). Pinch roller 48 is urged by coil spring 61, which is disposed in pinch roller holder 56 under compression, toward drive roller 47 (i.e., toward a segment AB).

When θ>0, the center O of an arc DE does not coincide with the center of rotation A of drive roller 47. Thus, as angle θ increases, pinch roller holder 56 gradually separates from drive roller 47, allowing coil springs 61 to extend. In other words, as angle θ increases, an elastic energy ϵ of the springs 61 decreases. At this time, moment M1 of a size proportional to dϵ/dθ, which is a decrease of the elastic energy ϵ, acts on pinch roller 48 in the counterclockwise direction about the center of rotation A, that is, a direction orthogonal to segment AB.

Frictional force (frictional moment) M2' is generated on the pinch roller 48. Frictional force M2' acts around the center of rotation B of pinch roller 48 in a direction opposite to a rotational direction in which the pinch roller 48 follows the rotation of drive roller 47. A moment that is converted from frictional force M2' about the center of rotation A, that is, in the direction orthogonal to the segment AB, is defined as M2. Frictional force M2' generated at this time is a static frictional force that is generated on a sliding surface between pinch roller 48 and rotary shaft 65 when pinch roller 48 is rotated. In FIG. 16, moment M2 is not shown.

When pinch roller holder 56 is rolled on curved surface 69 of the holder support member 57, rolling frictional force (frictional moment) M3' is generated. Rolling frictional force M3' acts about the center O, that is, in a direction orthogonal to the segment OB. A moment that is converted from rolling frictional force M3' about the center of rotation A, that is, in the direction orthogonal to the segment AB, is defined as M3. Moment M3 is regarded as the rolling frictional force. In FIG. 16, moment M3 is not shown.

When recording sheet is fed by drive roller 47 and pinch roller 48, a force W, which is, for example, an elastic force due to a weight or bending of recording sheet, acts toward the center of rotation B of pinch roller 48 as shown in FIG. 17. With the force W, moment M4 is generated in a direction to decrease angle θ. In this embodiment, as illustrated, recording sheet is fed while being pressed only by angle θ against platen 34 from above. Thus, moment M4 has a force having such a degree that may not be negligible. Stiffness of a recording sheet is identified as EI.

When the leading end of recording sheet enters between drive roller 47 and the pinch roller 48 or the trailing end comes off from drive roller 47 and pinch roller 48, the length of coil springs 61 varies only by a thickness h of recording sheet. When the leading end of recording sheet enters between drive roller 47 and the pinch roller 48, the springs 61 are shrunk by the thickness h. When the trailing end of recording sheet comes off from drive roller 47 and the pinch roller 48, the springs 61 expand by the thickness h. Thus, also in this case, the elastic energy ϵ of the springs 61 fluctuates, and moment M5 of a size proportional to dϵE/dθ, as with moment MI described above, is generated on pinch roller 48 about the center of rotation A.

Here, angle θ (θ1≦θ≦θ2), recording sheet's thickness h and, recording sheet's thickness h and, recording sheet's stiffness EI are variables. Thus, moment M1 can be expressed as a function of θ and h, moment M4 can be expressed as a function of θ and EI, and moment M5 can be expressed as a function of h. Moments M2 and M3 can be expressed as a function of θ and h strictly speaking, however, they are extremely small compared with moments M1, M4, and M5, and thus they are identified as constants. In the following, a function of angle θ is expressed as M1 (θ) and M4 (θ).

If the assumption is made that there is no slip between drive roller 47 and pinch roller 48 and the frictional force between drive roller 47 and pinch roller 48 and the frictional force between pinch roller 48 and a recording sheet is maximized, moments M1 to M5 satisfy the following expressions.

Expression 1 is established when a recording sheet is not fed by drive roller 47 and pinch roller 48.

$$M1(\theta)+M3>M2 \qquad \text{expression 1}$$

At this time, moment M2 acts around the center A in the clockwise direction, and moment M3 acts around the center A in the counterclockwise direction. Thus, in this case, pinch roller holder 56 rolls toward the upstream side with respect to the sheet feed direction, recedes rearward, and is maintained at a position satisfying θ=θ2 (receding position).

Expression 2 is established when recording sheet arrives at drive roller 47 and pinch roller 48 and the leading end of recording sheet is held therebetween upon the rotation of drive roller 47.

$$M1(\theta)+M3<M4(\theta)+M5 \qquad \text{expression 2}$$

At this time, moment M3 acts around the center A in the counterclockwise direction, and moment M5 acts around the center A in the clockwise direction. The pinch roller holder 56 rolls toward the downstream side with respect to the sheet feed direction, recedes rearward, and is maintained at a position satisfying θ=θ1 (the feeding position).

Expression 3 is established while recording sheet is being fed.

$$M1(\theta)<M2+M3+M4(\theta) \qquad \text{expression 3}$$

At this time, moment M2 acts around the center A in the clockwise direction, and moment M3 acts around the center A in the clockwise direction. Thus, pinch roller holder 56 is continuously maintained at the position satisfying θ=θ1 (the feeding position).

Expression 4 is established when the trailing end of recording sheet comes off from between drive roller 47 and pinch roller 48.

$$M1(\theta)+M5>M3 \qquad \text{expression 4}$$

At this time, moment M3 acts around the center A in the clockwise direction, and moment M5 acts around the center A in the counterclockwise direction, as with moment M1. As can be seen from the above expression, only moment M3, as the frictional force, acts on moment M1 (θ)+M5, which is generated when the trailing end of recording sheet comes off between drive roller 47 and pinch roller 48. Moment M1 (θ)+M5, however, is configured to roll pinch roller holder 56 toward the upstream side of recording sheet, is greater than moment M3 that prevents the rolling movement, the pinch roller holder 56 is rolled toward the upstream side of recording sheet. That is, moment M3 is relatively smaller than moment M1 (θ)+M5. Thus, moment M1 (θ)+M5 acts in order to roll pinch roller holder 56 toward the upstream side of recording sheet, so that the pinch roller holder 56 is promptly rolled. Once the pinch roller holder 56 recedes, it is maintained in an upstream position satisfying θ=θ2 (the receding position).

Expression 5 is established when drive roller 47 is rotated inversely after the trailing end of recording sheet comes off between drive roller 47 and pinch roller 48.

$$M1(\theta)+M2>M3 \qquad \text{expression 5}$$

Pinch roller holder 56 may not return to the position satisfying θ=θ2 (or the receding position) after the trailing end of recording sheet comes off between drive roller 47 and pinch roller 48. Thus, even if such an error occurs, pinch roller holder 56 can be rolled to the position satisfying θ=θ2 (or the receding position), when moment M2 acts around the center A in the counterclockwise direction, and moment M3 acts around center O in the clockwise direction.

As described above, in multifunction apparatus 1 that supports pinch roller holder 56 so as to roll via roller bearings 80, pinch rollers 48, pinch roller holder 56, holder support member 57, and springs 61 are disposed in order to establish expressions 1-5. Thus, when recording sheet is held by feed roller pair 54, pinch roller holder 56 is promptly rolled toward the downstream side with respect to the sheet feed direction. When recording sheet is released from feed roller pair 54, the pinch roller holder 56 is promptly rolled toward the upstream side with respect to the sheet feed direction. With this structure, compared with a prior art structure using sliding friction, an amount of sliding friction needed to feed recording sheet in the sheet feed direction can be set closer to zero. As a result, the quality of an image to be recorded on recording sheet may be prevented from deteriorating.

Although the embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. An image recording apparatus, comprising:

a support plate configured to support a recording medium to be fed in a feed direction;

an image recording unit disposed facing the support plate, said image recording unit configured to record an image on the recording medium fed onto said support plate;

a feeding unit comprising a drive roller and a driven roller urged towards said drive roller, the feeding unit configured to feed the recording medium to the support plate;

a first support member comprising an urging member, said urging member configured to apply a force urging said driven roller toward said drive roller, said first support member configured to support said driven roller rotatably;

at least one guide member disposed on said first support member, said guide member protruding toward said support plate; and a second support member configured to support said first support member, said second support member comprising a roller bearing, wherein said first support member is configured to be rolled to a first position via the roller bearing when said feeding unit feeds the recording medium, and wherein said first support member is configured to be rolled to a second position via said roller bearing when said feeding unit does not feed the recording medium, the second position being disposed at a position upstream in the feed direction relative to the first position.

2. The image recording apparatus according to claim 1, wherein said at least one guide member comprises a plurality of guide members arranged along an axial direction of said driven roller.

3. The image recording apparatus according to claim 2, wherein a plurality of rib members is disposed at an upstream end of said support plate, said rib members extending substantially along the feed direction and are arranged along the upstream end of said support plate in a direction substantially perpendicular to the feed direction; and wherein said plurality of guide members is configured to move along the feed direction in accordance with a rolling movement of said first support member between the first and second positions, said guide members arranged to advance or recede in spaces formed between adjacent rib members.

4. The image recording apparatus according to claim 3, wherein said guide members are arranged to overlap the upstream end of said support plate when said first support member is maintained in the second position.

5. The image recording apparatus according to claim 3, wherein said guide members are disposed at positions to support both sides of the recording medium to be supported by the support plate.

6. The image recording apparatus according to claim 5, wherein the recording medium comprises a standard sized recording sheet selected from the group consisting of: A-sized, B-sized, letter-sized, legal-sized, and postcard-sized.

7. The image recording apparatus according to claim 3, wherein the upstream end of said support plate comprises an inclined surface that is inclined downwardly from an upper surface of said support plate toward the upstream side in the feed direction; and wherein each guide member comprises a guide surface disposed below the upper surface of said support plate.

8. The image recording apparatus according to claim 7, wherein said guide surface of each guide member is disposed above a lower end of said inclined surface.

9. The image recording apparatus according to claim 1, wherein said first support member comprises a support part; and said second support member comprises:

a support surface configured to support said support part of said first support member via said roller bearing;

a first controlling member configured to limit a rolling movement of said first support member at the first position; and a second controlling member configured to limit the rolling movement of the first support member at the second position.

10. The image recording apparatus according to claim 9, wherein said roller bearing comprises a plurality of rotating members disposed between said support surface and said support part of said first support member.

11. The image recording apparatus according to claim 1, wherein said second support member is configured to support said first support member whereby said first support member is relatively separated from said drive roller when said first support member rolls from the first position to the second position.

12. The image recording apparatus according to claim 11, wherein said second support member is configured to roll said first support member around a center of revolution which is parallel with an axis of rotation of said drive roller.

13. The image recording apparatus according to claim 12, wherein the axis of rotation of said drive roller and the center of revolution defines an imaginary plane, wherein said second support member is movable about the center of revolution between the first position disposed at a first angle upstream from the imaginary plane and the second position disposed at a second angle upstream from the imaginary plane, and wherein the first angle is greater than or equal to zero and the second angle is greater than the first angle.

14. The image recording apparatus according to claim 12, wherein said support surface of said second support member has an arc shape that substantially conforms to an outer periphery of a cylindrical path about the center of revolution.

15. The image recording apparatus according to claim 1, wherein said first support member integrally supports a plurality of driven rollers disposed in a spaced parallel arrangement in an axial direction of said drive roller.

* * * * *